US011694674B1

(12) United States Patent
Abbas et al.

(10) Patent No.: US 11,694,674 B1
(45) Date of Patent: Jul. 4, 2023

(54) MULTI-SCALE SPECTROGRAM TEXT-TO-SPEECH

(71) Applicant: Amazon Technologies, Inc., Seattle, WA (US)

(72) Inventors: Syed Ammar Abbas, Cambridge (GB); Bajibabu Bollepalli, Cambridge (GB); Alexis Pierre Moinet, Cambridge (GB); Thomas Renaud Drugman, Carnieres (BE); Arnaud Vincent Pierre Yves Joly, Cambridge (GB); Panagiota Karanasou, Cambridge (GB); Sri Vishnu Kumar Karlapati, Cambridge (GB); Simon Slangen, Edinburgh (GB); Petr Makarov, Cambridge (GB)

(73) Assignee: Amazon Technologies, Inc., Seattle, WA (US)

( * ) Notice: Subject to any disclaimer, the term of this patent is extended or adjusted under 35 U.S.C. 154(b) by 71 days.

(21) Appl. No.: 17/331,427

(22) Filed: May 26, 2021

(51) Int. Cl.
*G10L 13/08* (2013.01)
*G10L 25/30* (2013.01)

(52) U.S. Cl.
CPC ..... *G10L 13/08* (2013.01); *G10L 25/30* (2013.01)

(58) Field of Classification Search
CPC ..... G10L 15/197
USPC ..... 704/260
See application file for complete search history.

(56) References Cited

U.S. PATENT DOCUMENTS

2020/0074985 A1* 3/2020 Clark ..... G10L 25/18
2021/0225358 A1* 7/2021 Monge Alvarez .... G10L 13/027
2022/0051654 A1* 2/2022 Finkelstein ..... G10L 13/02
2022/0122582 A1* 4/2022 Elias ..... G06F 40/126
2022/0189455 A1* 6/2022 Pekar ..... G06N 3/08

OTHER PUBLICATIONS

J. Shen et al., "Natural TTS Synthesis by Conditioning Wavenet on MEL Spectrogram Predictions," 2018 IEEE International Conference on Acoustics, Speech and Signal Processing (ICASSP), 2018, pp. 4779-4783, doi: 10.1109/ICASSP.2018.8461368. (Year: 2018).*

(Continued)

*Primary Examiner* — Bharatkumar S Shah
(74) *Attorney, Agent, or Firm* — Nicholson De Vos Webster & Elliott, LLP

(57) ABSTRACT

Techniques for performing text-to-speech are described. An exemplary method includes receiving a request to generate audio from input text; generating audio from the input text by: generating a first number of vectors from phoneme embeddings representing the input text, predicting one or more spectrograms having the first number of frames using multiple scales wherein a coarser scale influences a finer scale, concatenating the first number of vectors and the predicted one or more spectrograms, generating at least one mel spectrogram from the concatenated vectors and the predicted one or more spectrograms, and converting, with a vocoder, the at least one mel spectrogram frames to audio; and outputting the generated audio according to the request.

20 Claims, 13 Drawing Sheets

(56) References Cited

OTHER PUBLICATIONS

R. J. Weiss, R. Skerry-Ryan, E. Battenberg, S. Mariooryad and D. P. Kingma, "Wave-Tacotron: Spectrogram-Free End-to-End Text-to-Speech Synthesis," ICASSP 2021-2021 IEEE International Conference on Acoustics, Speech and Signal Processing (ICASSP), 2021, pp. 5679-5683, doi: 10.1109/ICASSP39728.2021.94 (Year: 2021).*

J. Shen et al., "Natural TTS Synthesis by Conditioning Wavenet on MEL Spectrogram Predictions," 2018 IEEE International Conference on Acoustics, Speech and Signal Processing (ICASSP), 2018, pp. 4779-4783, doi: 10.1109/ICASSP.2018.8461368. (Year: 2018) (Year: 2018).*

R. J. Weiss, R. Skerry-Ryan, E. Battenberg, S. Mariooryad and D. P. Kingma, "Wave-Tacotron: Spectrogram-Free End-to-End Text-to-Speech Synthesis," ICASSP 2021-2021 IEEE International Conference on Acoustics, Speech and Signal Processing (ICASSP), 2021, pp. 5679-5683, doi: 10.1109/ICASSP39728.2021.9 (Year: 2021).*

Akuzawa, Kei et al., Expressive Speech Synthesis via Modeling Expressions with Variational Autoencoder, INTERSPEECH 2018 (2018), pp. 3067-3071, https://www.isca-speech.org/archive_v0/Interspeech_2018/pdfs/1113.pdf.

BS Series, Method for the subjective assessment of intermediate quality level of audio systems, International Telecommunications Union Radiocommunication Assembly (2014), 36 pgs., https://www.itu.int/dms_pubrec/itu-r/rec/bs/R-REC-BS.1534-3-201510-I!!PDF-E.pdf.

Chien, Chung-Ming and Lee, Hung-yi, Hierarchical Prosody Modeling for Non-Autoregressive Speech Synthesis, arXiv:2011 06465v1 [eess.AS] (2020), 8 pgs., https://arxiv.org/pdf/2011.06465v1.pdf.

Curtin, Adrian et al., Cognitive Considerations in Auditory User Interfaces: Neuroergonomic Evaluation of Synthetic Speech Comprehension, Springer International Publishing (2017), pp. 106-116, https://link.springer.com/content/pdf/10.1007/978-3-319-58472-0_9.pdf.

Drugman, Thomas et al., Traditional Machine Learning for Pitch Detection, arXiv: 1903.01290v1 [cs.SD] (2019), 5 pgs., https://arxiv.org/pdf/1903.01290.pdf.

He, Mutian et al., Robust Sequence-to-Sequence Acoustic Modeling with Stepwise Monotonic Attention for Neural TTS, arXiv: 1906.00672 (2019), 5 pgs., https://arxiv.org/ftp/arxiv/papers/1906/1906.00672.pdf, Aug. 16, 2022.

Hodari, Zack et al., CAMP: A Two-Stage Approach to Modelling Prosody in Context, arXiv:2011.01175v2 [eess.AS] (2021), 5 pgs., https://arxiv.org/pdf/2011.01175.pdf.

Hsu, Wei-Ning et al., Hierarchical Generative Modeling for Controllable Speech Synthesis, arXiv:1810.07217v2 [cs.CL] (2018), 27 pgs., https://arxiv.org/pdf/1810.07217.pdf.

Karlapati, Sri et al., Prosodic Representation Learning and Contextual Sampling for Neural Text-To-Speech, arXiv:2011 02252v1 [eess.AS] (2020), 5 pgs., https://arxiv.org/pdf/2011.02252.pdf.

Kingma, Diederik P. et al., ADAM: A Method for Stochastic Optimization, arXiv:1412.6980v1 [cs.LG] (2014), 9 pgs., https://arxiv.org/pdf/1412.6980v1.pdf.

Lin, Binghuai et al., Joint detection of sentence stress and phrase boundary for prosody, INTERSPEECH 2020 (2020), pp. 4392-4396, http://www.interspeech2020.org/uploadfile/pdf/Thu-2-9-2.pdf.

Mehri, Soroush et al., SampleRNN: An Unconditional End-To-End Neural Audio Generation Model, arXiv:1612.07837v2 [cs.DS] (2017), 11 pgs., https://arxiv.org/pdf/1612.07837.pdf.

Ning, Yishuang et al., A Review of Deep Learning Based Speech Synthesis, Applied Sciences (2019), 16 pgs., vol. 9/No. 19, https://www.mdpi.com/2076-3417/9/19/4050.

Raitio, Tuomo et al., Controllable neural text-to-speech synthesis using intuitive prosodic features, arXiv:2009.06775v1 [eess AS] (2020), 5 pgs., https://arxiv.org/pdf/2009.06775.pdf.

Ren, Yi et al., FASTSPEECH 2: Fast and High-Quality End-To-End Text to Speech, arXiv:2006.04558v5 [eess AS] (2021), 15 pgs., https://arxiv.org/pdf/2006.04558v5.pdf.

Ruder, Sebastian, An Overview of Multi-Task Learning in Deep Neural Networks, arXiv: 1706.05098v1 [cs.LG] (2017), 14 pgs., https://arxiv.org/pdf/1706.05098.pdf.

Salimans, Tim et al., PixelCNN++: Improving the PIXELCNN With Discretized Logistic Mixture Likelihood and Other Modifications, arXiv:1701.05517c1 [cs.LG] (2017), 10 pgs., https://arxiv.org/pdf/1701.05517.pdf.

Shaham, Tamar Rott et al., SinGAN: Learning a Generative Model from a Single Natural Image, arXiv:1905.01164v2 [cs.CV] (2019), 11 pgs., https://arxiv.org/abs/1905.01164.

Shen, Jonathan et al., Natural TTS Synthesis by Conditioning Wavenet on MFI Spectrogram Predictions, arXiv:1712.05884V2 [cs.CL] (2018), 5 pgs., https://arxiv.org/pdf/1712.05884.pdf.

Shen, Jonathan et al., Non-Attentive Tacotron: Robust and Controllable Neural TTS Synthesis Including Unsupervised Duration Modeling, arXiv:2010.04301v4 [cs.SD] (2021), 14 pgs., https://arxiv.org/pdf/2010.04301.pdf.

Skerry-Ryan, RJ et al., Towards End-to-End Prosody Transfer for Expressive Speech Synthesis with Tacotron, arXiv: 1803.09047V1 [cs.CL] (2018), 11 pgs., https://arxiv.org/pdf/1803.09047.pdf.

Sun, Guangzhi et al., Generating Diverse and Natural Text-To-Speech Samples Using a Quantized Fine-Grained VAE and Autoregressive Prosody Prior, arXiv:2002.03788v1 [eess.AS] (2020), 5 pgs., https://arxiv.org/pdf/2002.03788.pdf.

Tjandra, Andros et al., Deja-Vu: Double Feature Presentation and Iterated Loss in Deep Transformer Networks, arXiv:1910.10324v2 [cs.CL] (2020), 5 pgs., https://arxiv.org/pdf/1910.10324.pdf.

Tyagi, Shubhi et al., Dynamic Prosody Generation for Speech Synthesis Using Linguistics-Driven Acoustic Embedding Selection, arXiv: 1912.00955v1 [cs.CL] (2019), 5 pgs., https://arxiv.org/pdf/1912.00955v1.pdf.

Van Den Oord, Aaron et al., Wavenet: A Generative Model for Raw Audio, arXiv: 1609.03499v2 [cs.SD] (2016), 15 pgs., https://arxiv.org/pdf/1609.03499.pdf.

Vasquez, Sean and Lewis, Mike, MelNet: A Generative Model for Audio in the Frequency Domain, arXiv: 1906.01083v1 [eess.AS] (2019), 14 pgs , https://arxiv.org/pdf/1906.01083.pdf.

Wan, Vincent et al., CHiVE: Varying Prosody in Speech Synthesis with a Linguistically Driven Dynamic Hierarchical Conditional Variational Network, arXiv:1905.07195v2 [cs CL] (2019), 10 pgs , https://arxiv.org/pdf/1905.07195.pdf.

Wang, Yuxuan et al., Tacotron: Towards End-To-End Speech Synthesis, arXiv: 1703.10135v2 [cs.CL] (2017), 10 pgs., https://arxiv.org/pdf/1703.10135.pdf.

Yu, Chengzhu et al., Durian: Duration Informed Attention Network for Multimodal Synthesis, arXiv: 1909.01700v2 [cs.CL] (2019), 11 pgs., https://arxiv.org/pdf/1909.01700.pdf.

Zen, Heiga et al., Statistical Parametric Speech Synthesis, Speech Communication (2009), 24 pgs., vol. 51/No. 11.

Zeng, Zhen et al., ALIGNTTS: Efficient Feed-Forward Text-To-Speech System Without Explicit Alignment, arXiv:2003.01950v1 [eess.AS] (2020), 5 pgs., https://arxiv.org/pdf/2003.01950.pdf.

Zhang, Guangyan et al., Learning Syllable-Level Discrete Prosodic Representation for Expressive Speech Generation, INTERSPEECH 2020 (2020), pp. 3426-3430, http://www.interspeech2020.org/index.php?m=content&c=index&a=show&catid=338&id=1007.

* cited by examiner

MULTI-SCALE SPECTROGRAM TEXT-TO-SPEECH

BACKGROUND

Modern text-to-speech (TTS) systems directly predict spectrograms which are high dimensional across both frequency (e.g., an 80-band spectrum) and time axes (e.g., a 12.5 ms frame shift) given text as an input. These TTS systems are able to generate speech with good segmental quality, however, the information present in higher frequencies of spectrograms is more stochastic in nature which makes it difficult for the model to capture such kind of information losing some rich details in the speech. Similarly, the way current TTS systems model across time axis is also an under-defined problem. This is because the input textual tokens are in discrete domain and have small/coarse time resolution, whereas the output spectrograms are in continuous domain with a very high/finer time resolution.

BRIEF DESCRIPTION OF DRAWINGS

Various embodiments in accordance with the present disclosure will be described with reference to the drawings, in which.

DETAILED DESCRIPTION

The present disclosure relates to methods, apparatus, systems, and non-transitory computer-readable storage media for performing text-to-speech. In some embodiments, resolution mismatch is handled by upsampling input text information (tokens, phonemes, etc.) to match the output spectrogram frames with the help of a duration model (explicit) or via attention (implicit). As detailed below, various levels (word, phoneme, etc.) of spectrograms are built in a systematic manner using multiple scales across frequency domain and/or predicted across a time domain. A final mel spectrogram is generated based on these built spectrograms. The mel spectrogram can then be used to generate audio data.

However, TTS systems still struggle to produce speech with appropriate prosody compared to human speech. This is mainly due to the lack of prosodic variations in the synthetic speech compared to human speech. The perceived prosody in the synthesized speech often sounds inappropriate given the textual context, and includes problems such as wrong type of into-nation, pausing, or emphasis. The lack of appropriate prosody stem from multiple reasons ranging from the model design to the way data is processed. Although the prosody is a suprasegmental phenomenon, existing TTS systems are designed in way that they take fine textual representations such as phonemes as an input and predict finer level acoustic representation such as mel spectrograms as an output. Thus, the speech produced by the TTS system can sound flat and require more cognitive effort to process it.

Detailed herein are embodiments that capture short and long-range dependencies observed in the speech signal. In particular, multi-scale spectrogram (MSS) modeling is detailed wherein mel spectrograms are predicted sequentially from a coarser scale capturing higher level representation of speech to a finer scale capturing fine-grained prosodic details. Each subsequent finer scale is conditioned by the previous scale's predicted mel-spectrograms. This allows the MSS modelling to produce prosody appropriate at different linguistic units such as sentence, word and phonemes, thereby improving the overall naturalness of the NTTS systems.

Figure 1:
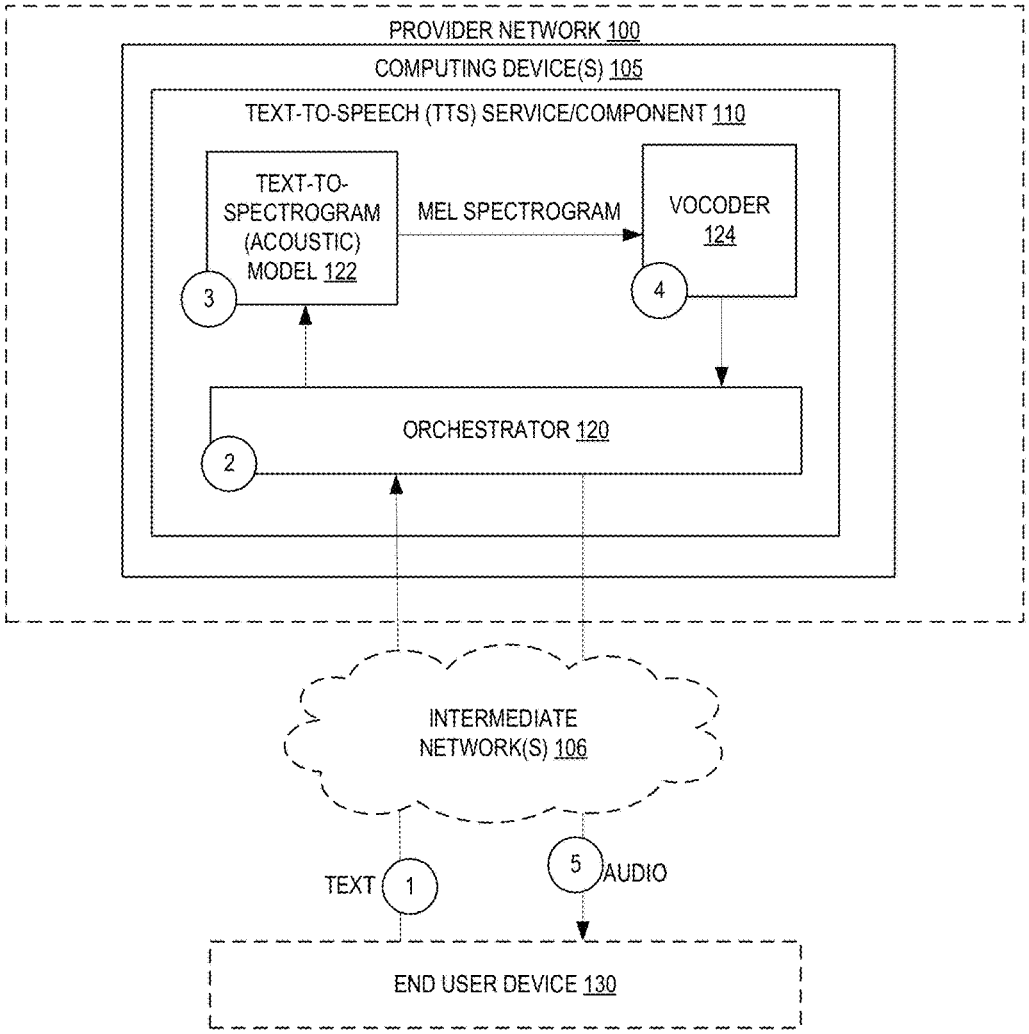
FIG. 1 illustrates embodiments of a text-to-speech service/component

FIG. 1 illustrates embodiments of a text-to-speech service/component. The TTS service/component 110 includes a text-to-speech (acoustic) model 122 (detailed more below) which takes in text and/or phonemes and generates a mel spectrogram as will be detailed below. The TTS service/component 110 operates in one or more computing devices 105.

In particular, the model 122 takes a hierarchical approach to mel spectrogram generation across at least the time axis. At a high-level the acoustic model 122, in some embodiments, uses an encoder/decoder model framework. The encoder operates a plurality of levels (e.g., word-level, phoneme-level, etc.) and for each level generates one or more spectrograms having a set number of frames. These spectrograms are generated in a hierarchical manner in at least the time domain.

The generated spectrograms are concatenated (or otherwise combined) and fed to a decoder which generates the mel spectrogram(s). The mel spectrogram(s) is/are then subjected to a vocoder 124 (voice encoder) that converts the mel spectrogram(s) to produce an audio signal. Exemplary vocoders include, but are not limited to: neural vocoders (e.g., WaveNet, FFTNet (FFTN), WaveRNN, LPCNet, WaveGlow, etc.) and non-neural vocoders. The generated audio is the provided to a requester, stored for later use, etc.

An orchestrator 120 receives text, phonemes, audio data to be converted to text, etc. to be converted from text-to-speech. The orchestrator 120 is configured to enable the orchestrator 120 to transmit various pieces and forms of data to various components of the TTS service/component 110. In some embodiments, the orchestrator 120 is configured to generate phonemes (and/or embeddings) from input text. The orchestrator may also be used to train the acoustic model 122 to have a certain "voice" (e.g., a celebrity, etc.) to be used in the generation of mel spectrograms.

In some embodiments, the TTS service/component 110 is a part of a provider network's offerings. A provider network 100 (or, "cloud" provider network) provides users with the ability to use one or more of a variety of types of computing-related resources such as compute resources (e.g., executing virtual machine (VM) instances and/or containers, executing batch jobs, executing code without provisioning servers), data/storage resources (e.g., object storage, block-level storage, data archival storage, databases and database tables, etc.), network-related resources (e.g., configuring virtual networks including groups of compute resources, content delivery networks (CDNs), Domain Name Service (DNS)), application resources (e.g., databases, application build/deployment services), access policies or roles, identity policies or roles, machine images, routers and other data processing resources, etc. These and other computing resources may be provided as services, such as a hardware virtualization service that can execute compute instances, a storage service that can store data objects, etc. The users (or "customers") of provider networks 100 may use one or more user accounts that are associated with a customer account, though these terms may be used somewhat interchangeably depending upon the context of use. Users may interact with a provider network 100 across one or more intermediate networks 106 (e.g., the internet) via one or more interface(s), such as through use of application programming interface (API) calls, via a console implemented as a website or application, etc. An API refers to an interface and/or communication protocol between a client and a server, such that if the client makes a request in a predefined format, the client should receive a response in a specific format or initiate a defined action. In the cloud provider network context, APIs provide a gateway for customers to access cloud infrastructure by allowing customers to obtain data from or cause actions within the cloud provider network, enabling the development of applications that interact with resources and services hosted in the cloud provider network. APIs can also enable different services of the cloud provider network to exchange data with one another. The interface(s) may be part of, or serve as a front-end to, a control plane of the provider network 100 that includes "backend" services supporting and enabling the services that may be more directly offered to customers.

For example, a cloud provider network (or just "cloud") typically refers to a large pool of accessible virtualized computing resources (such as compute, storage, and networking resources, applications, and services). A cloud can provide convenient, on-demand network access to a shared pool of configurable computing resources that can be programmatically provisioned and released in response to customer commands. These resources can be dynamically provisioned and reconfigured to adjust to variable load. Cloud computing can thus be considered as both the applications delivered as services over a publicly accessible network (e.g., the Internet, a cellular communication network) and the hardware and software in cloud provider data centers that provide those services.

A cloud provider network can be formed as a number of regions, where a region is a geographical area in which the cloud provider clusters data centers. Each region includes multiple (e.g., two or more) availability zones (AZs) connected to one another via a private high-speed network, for example a fiber communication connection. An AZ (also known as an availability domain, or simply a "zone") provides an isolated failure domain including one or more data center facilities with separate power, separate networking, and separate cooling from those in another AZ. A data center refers to a physical building or enclosure that houses and provides power and cooling to servers of the cloud provider network. Preferably, AZs within a region are positioned far enough away from one another so that a natural disaster (or other failure-inducing event) should not affect or take more than one AZ offline at the same time.

Customers can connect to AZ of the cloud provider network via a publicly accessible network (e.g., the Internet, a cellular communication network), e.g., by way of a transit center (TC). TCs are the primary backbone locations linking customers to the cloud provider network and may be collocated at other network provider facilities (e.g., Internet service providers (ISPs), telecommunications providers) and securely connected (e.g., via a VPN or direct connection) to the AZs. Each region can operate two or more TCs for redundancy. Regions are connected to a global network which includes private networking infrastructure (e.g., fiber connections controlled by the cloud provider) connecting each region to at least one other region. The cloud provider network may deliver content from points of presence (or "POPs") outside of, but networked with, these regions by way of edge locations and regional edge cache servers. This compartmentalization and geographic distribution of computing hardware enables the cloud provider network to provide low-latency resource access to customers on a global scale with a high degree of fault tolerance and stability.

To provide these and other computing resource services, provider networks 100 often rely upon virtualization techniques. For example, virtualization technologies may provide users the ability to control or use compute resources (e.g., a "compute instance," such as a VM using a guest operating system (O/S) that operates using a hypervisor that may or may not further operate on top of an underlying host O/S, a container that may or may not operate in a VM, a compute instance that can execute on "bare metal" hardware without an underlying hypervisor), where one or multiple compute resources can be implemented using a single electronic device. Thus, a user may directly use a compute resource (e.g., provided by a hardware virtualization service) hosted by the provider network to perform a variety of computing tasks. Additionally, or alternatively, a user may indirectly use a compute resource by submitting code to be executed by the provider network (e.g., via an on-demand code execution service), which in turn uses one or more compute resources to execute the code—typically without the user having any control of or knowledge of the underlying compute instance(s) involved.

For example, in various embodiments, a "serverless" function may include code provided by a user or other entity—such as the provider network itself—that can be executed on demand Serverless functions may be maintained within a provider network by an on-demand code execution service, and may be associated with a particular user or account, or may be generally accessible to multiple users/accounts. A serverless function may be associated with a Uniform Resource Locator (URL), Uniform Resource Identifier (URI), or other reference, which may be used to invoke the serverless function. A serverless function may be executed by a compute resource, such as a virtual machine, container, etc., when triggered or invoked. In some embodiments, a serverless function can be invoked through an application programming interface (API) call or a specially formatted HyperText Transport Protocol (HTTP) request message. Accordingly, users can define serverless functions that can be executed on demand, without requiring the user to maintain dedicated infrastructure to execute the serverless function. Instead, the serverless functions can be executed on demand using resources maintained by the provider network 100. In some embodiments, these resources may be maintained in a "ready" state (e.g., having a pre-initialized runtime environment configured to execute the serverless functions), allowing the serverless functions to be executed in near real-time.

The circles with numbers inside indicate an exemplary flow. At circle 1, an end user device 130 sends text to the TTS service/component 110. The orchestrator 120 receives this text at circle 2 and calls the acoustic model 122 to generate mel spectrograms for the text.

The acoustic model 122 generates one or more mel spectrograms at circle 3 and feds the vocoder 124 (as directed by the orchestrator 120). The vocoder, at circle 4, generates audio from the mel spectrogram(s). The audio is sent by the TTS service/component 110 (via the orchestrator 12) to the end user device 130.

Figure 2:
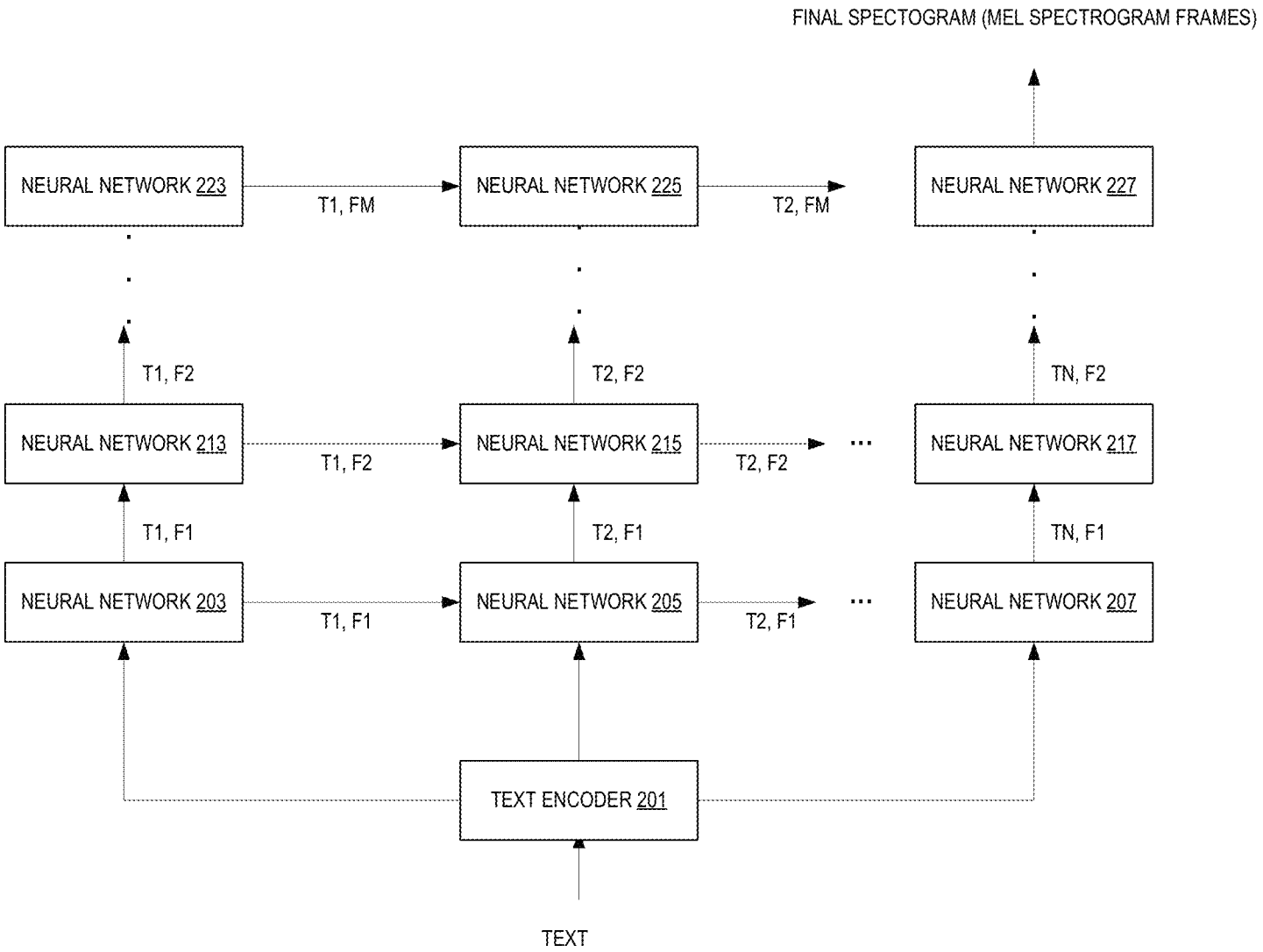
FIG. 2 illustrates embodiments of a system for generating mel spectrograms in a hierarchical manner.

FIG. 2 illustrates embodiments of a system for generating mel spectrograms in a hierarchical manner. As shown, a text encoder 201 encodes (or embeds) text. This encoded text is fed into a plurality of neural networks (203, 205, 207), each of which generates a spectrogram at a time scale (Ti) and a frequency scale (Fj). As shown, a first neural network at T1, F1 generates a first spectrogram. This spectrogram is fed to two different neural networks, one 213 with the same time, but a different frequency and one 215 with a different time, but the same frequency. This hierarchy continues in both domains as shown (e.g., from 215 to 225 and 217, 'INVF13 to 223 and 225, 'INVF17 to 227, etc.)

As such, the spectrograms are built in in a systematic manner using multiple scales across frequency domain. The direct prediction of full-band spectrum often results in a lower quality of synthetic speech because of the noise presented in higher frequencies as stated above. As such, the full-band spectrum in a sequential manner (e.g., first estimate the lower frequencies as they are relatively easier to model and later use them to predict all subsequent higher frequencies). This kind of conditioning allows the model to render more precise full-bank spectrograms that indirectly increase the quality of synthesized speech.

As done on frequency axis, a similar approach is used for prediction of spectrogram across time axis. At each step, the spectrograms are predicted at different time scales. Often, these scales can be matched to specific levels (e.g., spectrogram construction at sentence, word, and phoneme levels). This allows for capture the prosody information at multiple scales (e.g., both the fine-grained and coarse-grained prosody, and finer levels are dependent on the coarser levels such that word-level spectrogram construction is dependent on sentence-level spectrogram and so on). Prosody refers to the manner in which a given word, sentence, paragraph, or other unit of speech is spoken. Aspects of prosody may include the rate of the speech, the loudness of the speech, how syllables, words, or sentences in the speech are emphasized, when and where pauses in the speech may be inserted, or what emotion (e.g., happy, sad, or anxious) is expressed in the speech.

Figure 3:
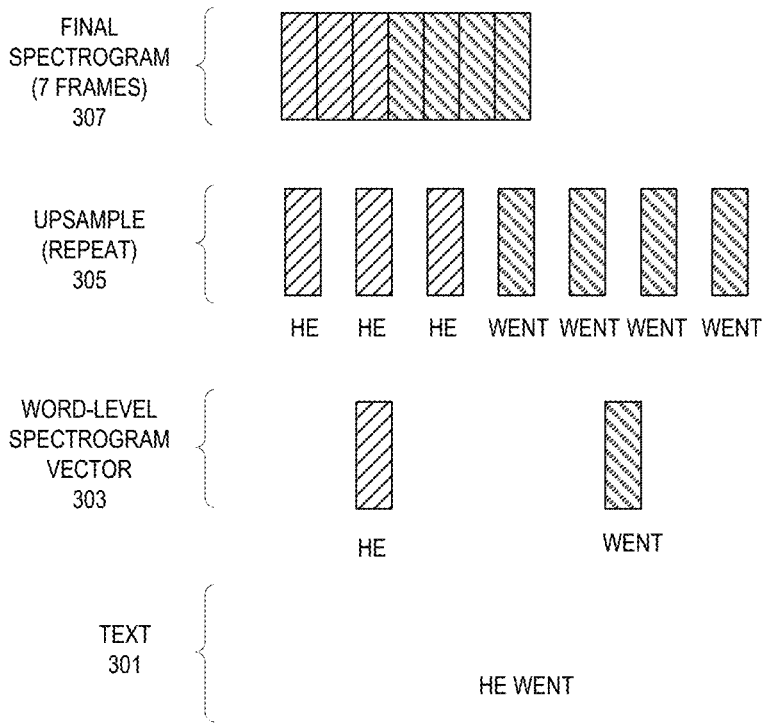
FIG. 3 illustrates embodiments of a high-level process flow for building a word-level spectrogram.

Note that in some embodiments, only one of the frequency or time axis is evaluated (e.g., in view of the figure, a vertical (frequency) or horizontal (time) evaluation is performed), FIG. 3 illustrates embodiments of a high-level process flow for building a word-level spectrogram having a plurality of frames. Note that similar flows may be used to build other levels of spectrograms. As shown, text 301 is first predicted into one or more word-level vectors 303 using a first model. In this example, there is a vector for the word "he" and a vector for the word "went."

These word-level vectors 303 are then upsampled (repeated) 305 to fit a particular size. In some embodiments, this size is a frame. Frames may have different characteristics and in some embodiments a frame has a size of 50 ms. In some embodiments, the upsampling is aligned. For example, word-level and phoneme-level spectrograms are calculated from the predicted spectrograms using the frame alignments from frames to words and ground truth spectrograms and from frames to phonemes and ground truth spectrograms respectively. During at least training, using these alignments, the spectrograms are subjected to an aggregation function such as averaging, maximum, minimum, etc. across the time-axis on word-level and phoneme level.

The upsampled (and aligned) spectrogram 305 includes a plurality of frames (in this example 7) are then used to generate a final spectrogram 307 having a set number of frames.

Figure 4:
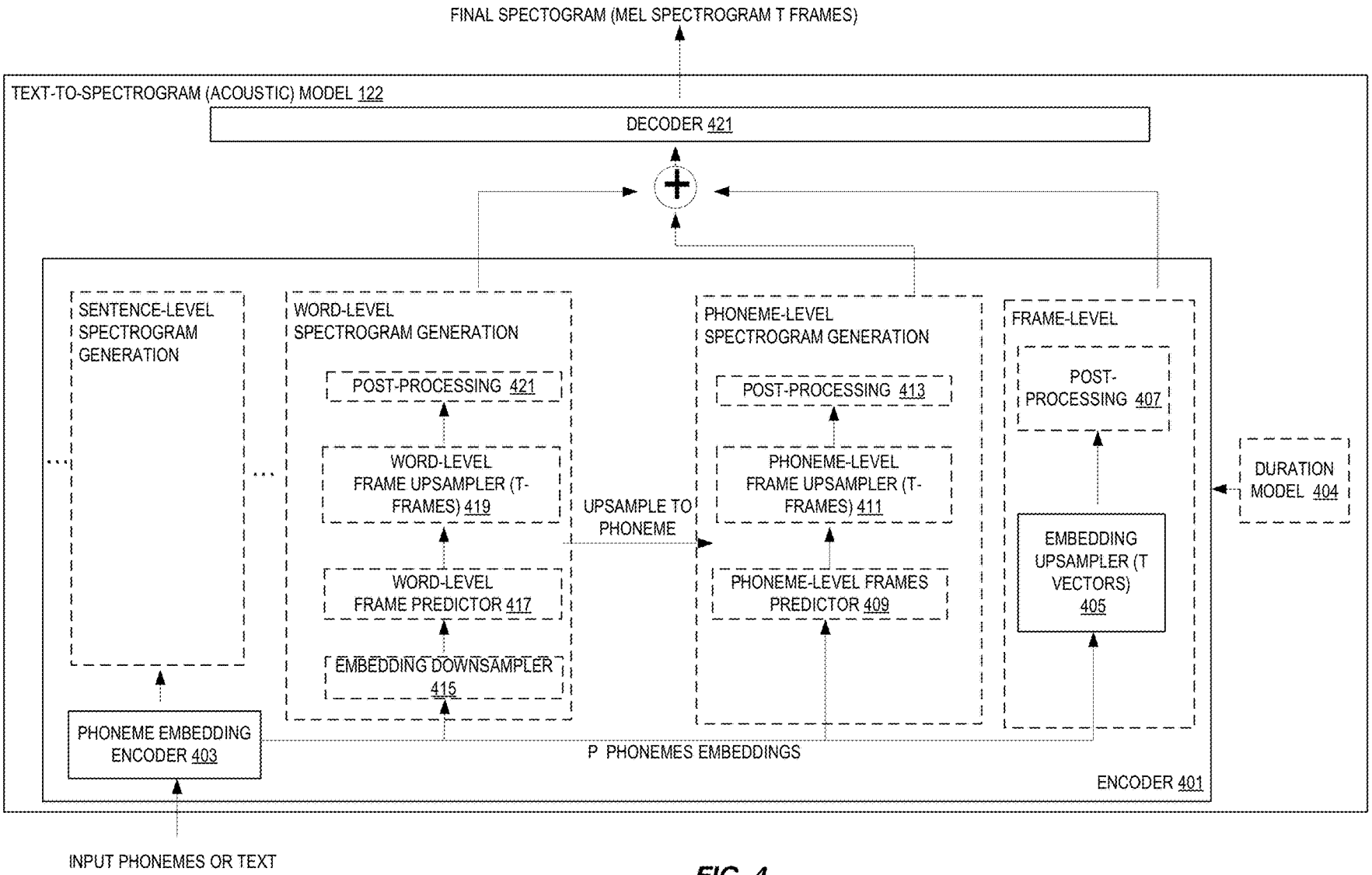
FIG. 4 illustrates embodiments of a text-to-spectrogram (acoustic) model.

FIG. 4 illustrates embodiments of a text-to-spectrogram (acoustic) model. In some embodiments, this is the acoustic model 122 of FIG. 1. In general, the acoustic model predicts spectrograms at a first level (e.g., sentence-level) and uses that predicted spectrogram at a second level (e.g., word-level). Subsequent levels (e.g., a third level) will use at least the preceding level's predicted spectrogram, but also use all other levels' spectrograms in some embodiments. The predicted spectrograms and upsampled frames of the frame-level are then used to predict an "actual" spectrogram.

Specifically, the acoustic model 112 predicts spectrogram vectors representing speech on a coarser scale which are later used for the prediction of spectrogram vectors representing speech on a finer scale. The coarser scale representation captures most of the suprasegmental related aspects of the prosody resulting in a more appropriate prosody for the given text. In principle, these scales can be defined in both time and frequency axes of the mel-spectrogram. In embodiments detailed herein, the scales are defined only across the time axis while keeping the number of mel-bins constant across frequency axis.

Figure 8:
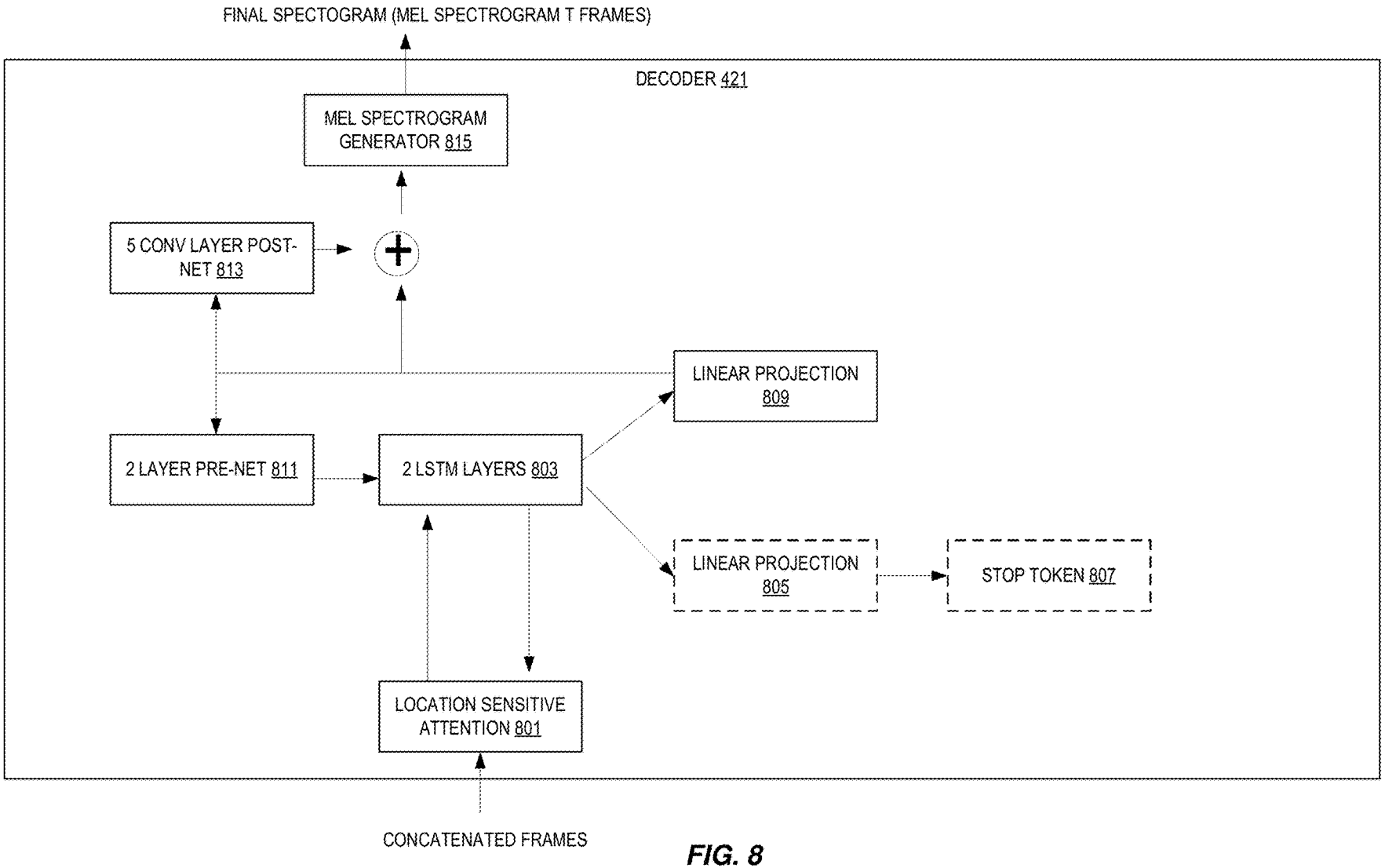
FIG. 8 illustrates embodiments of an auto-regressive decoder.

As shown, this model 122 may include a plurality of spectrogram generating components in an encoder portion 401 which are concatenated (or otherwise combined) to be decoded by a decoder 421. In some embodiments, the decoder 421 is an auto-regressive decoder. In some embodiments, the decoder 421 is a parallel decoder. In this illustration, the encoder 401 is shown in greater detail. FIG. 8 illustrates exemplary embodiments of an auto-regressive decoder.

A frame-level component generates one or more frames from phoneme embeddings. A phoneme embedding encoder 403 generates phoneme embeddings. In this example, "p" phoneme embeddings are generated from input phonemes and/or text input data. The phoneme encoder 4003, in some embodiments, is a neural network and processes the input data to determine the phoneme embedding data, which may be a vector of N values that represents the sequence. When the input data is a sequence of phonemes representing a word, for example, the phoneme embedding data is a vector of values that uniquely represents the word. Similarly, if the input data is a sequence of phonemes representing a sentence, paragraph, chapter, or book, etc., the phoneme embedding data is a vector of values that uniquely represents the sentence, paragraph, chapter, or book, etc. The phoneme embedding data thus corresponds to a point in an embedding space corresponding to the input data, wherein the embedding space is an N-dimensional space representing all possible words, sentences, paragraphs, chapters, or books. Points near each other in the embedding space may represent similar items of input data, while points far from each other in the embedding space may represent dissimilar items of input data. Note a subset of the phoneme embedding encoder 403 may logically be separated from the encoder 401 (such as being a part of orchestrator 120 of FIG. 1).

Figure 5:
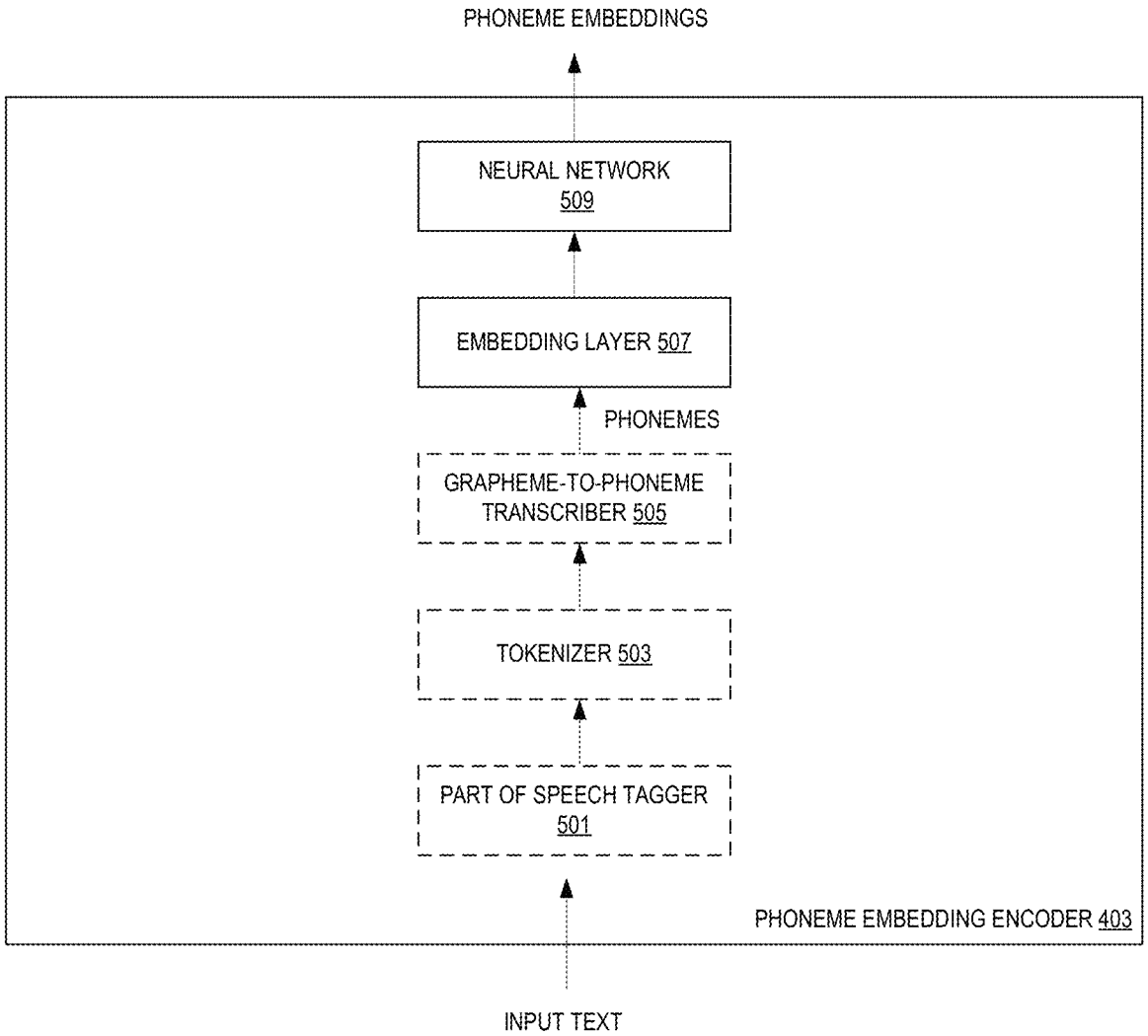
FIG. 5 illustrates embodiments of an exemplary phoneme embedding encoder.

FIG. 5 illustrates embodiments of an exemplary phoneme embedding encoder. In some embodiments, the phoneme embedding encoder 403 includes one or more of: a part of speech tagger 501 to tag input text with a corresponding part of speech (e.g., noun, verb, article, adjective, etc.); a tokenizer 503 to tokenize the word(s) of the input text; a grapheme-to-phoneme transcriber 505 to convert graphemes into phonemes (in some embodiments, a set of rules is used to perform this conversion, in other embodiments a neural network is used); an embedding layer INVE07 to embed phonemes into one or more trainable vectors; and a neural network (e.g., BI-LSTM) 509 to generate the phoneme embeddings.

The "p" phonemes embeddings are provided to one or more spectrogram generation "levels" within the encoder 401. A phoneme level spectrogram generation component takes in the phoneme embeddings and upsamples them using upsampler 405 to generate "t" vectors (where "t" corresponds to the number of frames generated by one or more of a word-level frame component, a phoneme-level frame component, a sentence-level frame component, etc.). In some embodiments, a post-processor 407 is applied to the "t" vectors. In some embodiments, during training, the upsampler 405 is trained by an oracle providing a duration value and/or during inference, the oracle durations are replaced with predicted durations from a durations model 404. The durations model 404 takes in phonemes to predict durations. Note that the phoneme-level of generating upsampled vectors is where prior systems stop. There are no frame-level spectrograms generated.

A word-level spectrogram generation component, as shown, includes one more of an embedding downsampler 415, a word-level frame predictor 417, a word-level frame upsampler 419, and/or a post-processor 'INV21. The embedding downsampler 415 downsamples (e.g., averages) the phoneme embeddings to create a number of fixed-dimensional vectors. These vectors are taken in by the word-level frame predictor 417 to generate one or more spectrogram frames (during training, a L1, L2, or other loss function is utilized to train the predictor). In some embodiments, a prediction of the spectrograms at different time scales is made. In some embodiments, this prediction is generated using a convolutional neural network followed by a LSTM. The one or more spectrogram frames are upsampled (and aligned) using the word-level frame upsampler 419 to "t" frames of a spectrogram. As such, a prediction of the spectrogram at a frame level is made. In some embodiments, the post-processor 421 is applied to the "t" frames.

A phoneme-level spectrogram generation component, as shown, includes one more of a phoneme-level frame predictor 409, a phoneme-level frame upsampler 411, and/or a post-processor 413. The phoneme-level frame predictor 409 takes in phoneme embeddings upsampled frames to generate one or more spectrogram frames (during training, a L1, L2, or other loss function is utilized to train the predictor). In some embodiments, a prediction of the spectrograms at different time scales is made. In some embodiments, this prediction is generated using a convolutional neural network followed by a LSTM. The one or more spectrogram frames are upsampled (and aligned) using the phoneme-level frame upsampler 411 to "t" frames of a spectrogram. As such, a prediction of the spectrogram at a frame level is made. In some embodiments, the post-processor 413 is applied to the "t" frames.

The spectrograms generated in the various levels are concatenated (or otherwise combined) with the one or more frames of the frame-level and fed to the decoder 421 which generates a Mel spectrogram having "t" frames.

Figure 6:
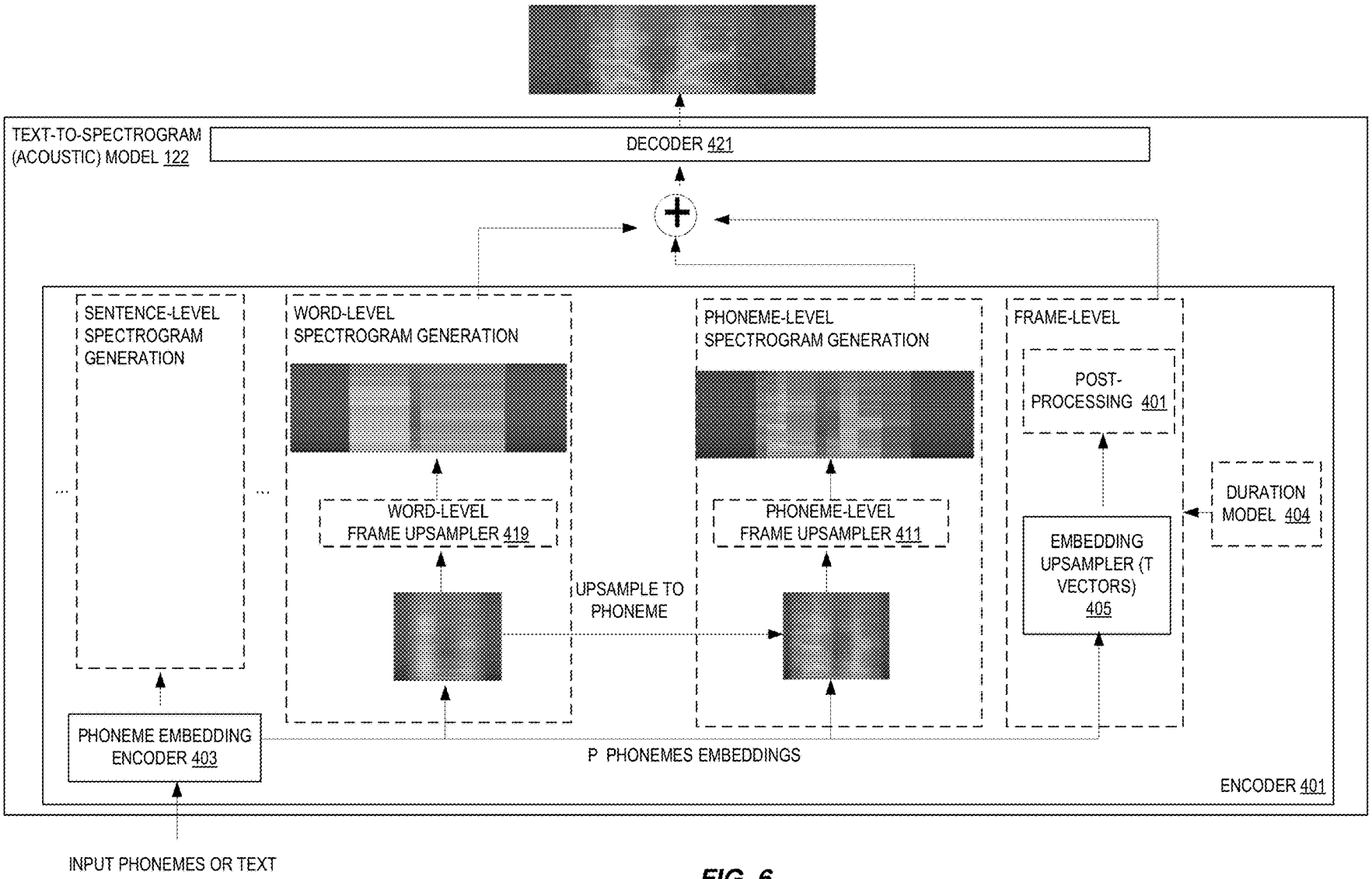
FIG. 6 illustrates embodiments of an acoustic model and illustrates exemplary spectrograms.

FIG. 6 illustrates embodiments of an acoustic model and illustrates exemplary spectrograms. In the illustrated spectrograms, each vertical vector is a frame (in frequency) and the X-axis is split into chunks of time for each frame (e.g., 12.5 ms).

Figure 7:
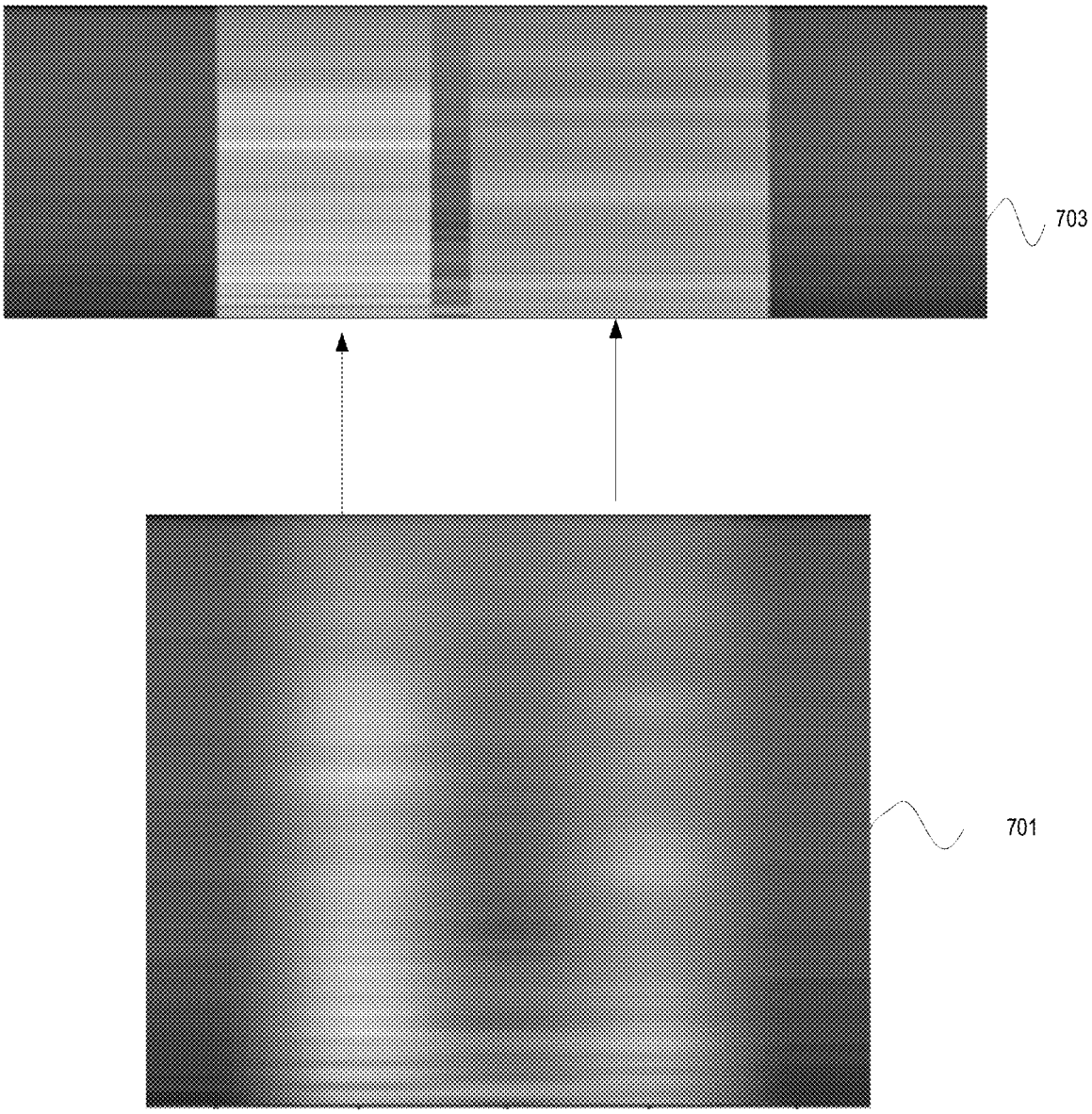
FIG. 7 illustrates exemplary spectrograms.

FIG. 7 illustrates exemplary spectrograms. In particular, spectrogram 701 is a spectrogram having two frames that has not been upscaled. Spectrogram 703 shows those frames being upscaled. Additionally, post-processing has cleaned up spectrogram 703.

FIG. 8 illustrates embodiments of an auto-regressive decoder. In some embodiments, this decoder is decoder 421. The encoder output (concatenated spectrogram frames) is consumed by an attention network which summarizes the full encoded sequence as a fixed-length context vector for each decoder output step. Location-sensitive attention 801 uses cumulative attention weights from previous decoder time steps as an additional feature. Attention probabilities are computed after projecting inputs and location features to multi-dimensional hidden representations. Location features are computed using 1-D convolution filters.

The decoder is an autoregressive recurrent neural network which predicts a mel spectrogram from the encoded input sequence one frame at a time. The prediction from the previous time step is first passed through a small pre-net 811 containing fully connected layers of hidden ReLU units. The pre-net 811 output and attention context vector are concatenated and passed through a stack of uni-directional LSTM layers 803. The concatenation of the LSTM output and the attention context vector is projected through a linear transform 809 to predict a target spectrogram frame. Finally, the predicted mel spectrogram is passed through a multi-layer convolutional post-net 813 which predicts a residual to add to the prediction to improve the overall reconstruction.

Each post-net layer is comprised of filters with batch normalization, followed by activations on all but the final layer. The summed mean squared error (MSE) is minimized before and after the post-net to aid convergence.

A mel spectrogram generator 815 generates a final mel spectrogram (having "t" frames). In some embodiments, mel spectrograms are computed through a short-time Fourier transform (STFT) using a 50 ms frame size, 12.5 ms frame hop, and a Hann window function. The STFT magnitude is transformed to the mel scale using an 80 channel mel filterbank spanning 125 Hz to 7.6 kHz, followed by log dynamic range compression. Prior to log compression, the filterbank output magnitudes are clipped to a minimum value of 0.01 in order to limit dynamic range in the logarithmic domain.

In some embodiments, in parallel to the spectrogram frame prediction, a concatenation of decoder LSTM 803 output and the attention context is projected down using projection 805 to a scalar and passed through a sigmoid activation 807 to predict the probability that the output sequence has completed. This "stop token" prediction may be used during inference to allow the model to dynamically determine when to terminate generation instead of always generating for a fixed duration.

Figure 9:
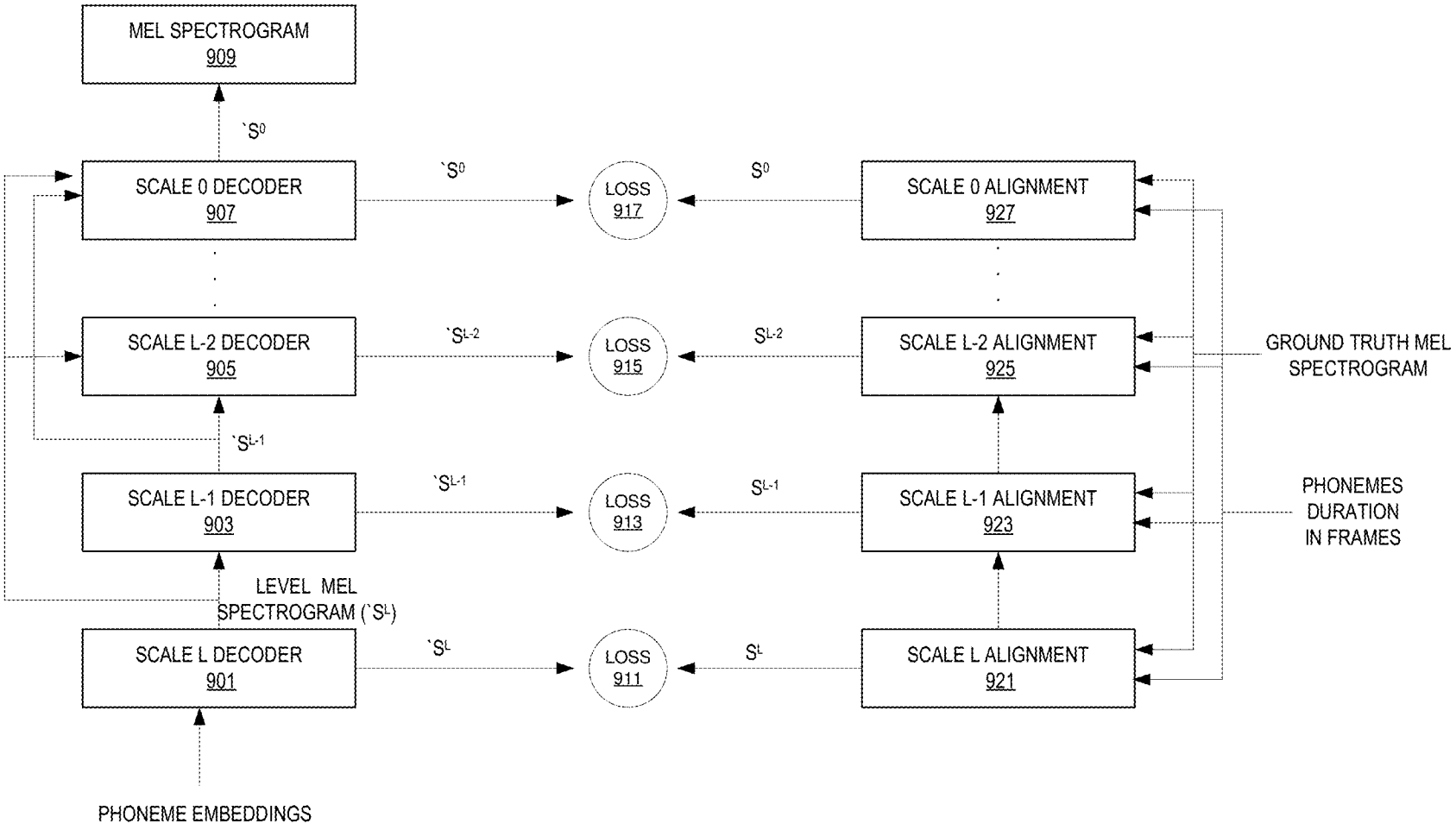
FIG. 9 illustrates embodiments of an acoustic model

FIG. 9 illustrates embodiments of an acoustic model using MSS modeling. A shown, the model has a plurality of scales (L+1). At each scale, where $0 \le 1 \le L$, a mel spectrogram (S) is computed having dimensions $N^1 \times 80$ from a ground truth spectrogram having a dimension of $T \times 80$. These mel spectrograms are aligned using alignment vectors 921-927.

In particular, a given mel spectrogram is computed according to $S^l=[s_0^l, s_1^l, \ldots s_{N^l-1}^l]$, where each $$s_i^l = \begin{cases} \frac{1}{a_i^l} \sum_{j=c_{i-1}^l}^{c_i^l} y_j, & 1 \le j <= N^l, \\ \frac{1}{a_i^l} = \sum_{j=0}^{c_i^l} y_j, & i = 0. \end{cases}$$

$$c_k^l = \sum_{i=0}^{k} a_i^l$$

Each $a^l=[a_0^l, a_1^l, \ldots a_{N^l-1}^l]$ is an alignment vector that denotes the alignments at scale 1>0 where each $a_i^l$ represents a number of mel spectrogram fames of the ground truth spectrogram corresponding to the spectrogram $s_i^l$ at scale 1. The mel spectrogram $S^0$ at the $0^{th}$ scale is equal to the target (ground truth) spectrogram.

The Word-level MSS has a total number of three scales (L=2) where $1^{st}$ and $2^{nd}$ scales correspond to the linguistic unit of phonemes and words respectively. The $0^{th}$ scale corresponds to frame-level mel-spectrogram as discussed above. The $N^2$=number of words in a given utterance, $N^1$=number of phonemes present in an utterance, and $N^0$=T. The alignment vectors $a^1$ are obtained from the phoneme durations, and relations between phoneme, word and sentences obtained by the front-end. More specifically, in Sentence-level MSS, the alignment vector $a^1$ is equal to the phoneme durations (d) in frames. The alignment vector $a^2$ is equal to the word durations in frames, etc.

The various linguistic level spectrograms ('S) are generated by decoders 901-909. The $'S^3$ (sentence level) spectrogram captures sentence level acoustic properties such as speaker identity, recording environment, and/or speaking style. The $'S^2$ (word level) spectrogram captures sentence level acoustic properties such as word prominence and/or rise and fall of pitch and energy and the word level. The $'S^1$ represents the phoneme level spectrogram.

Each level has a loss function (911-917) defined as $L=\|'S-S\|_2$ and the overall loss is the some of the losses of each scale.

Figure 10:
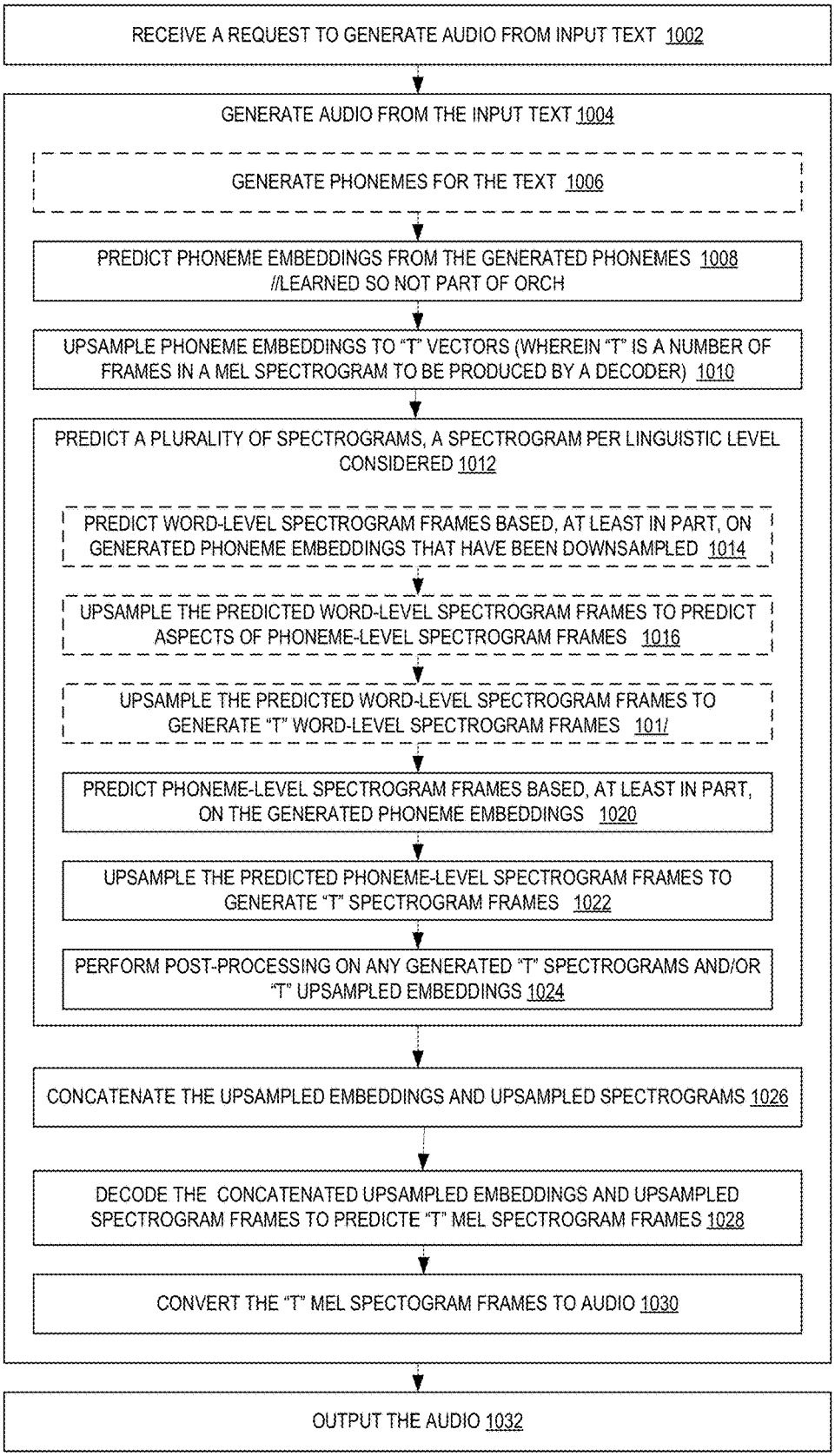
FIG. 10 is a flow diagram illustrating operations of a method for performing text-to-speech according to some embodiments.

FIG. 10 is a flow diagram illustrating operations of a method for performing text-to-speech according to some embodiments. Some or all of the operations (or other processes described herein, or variations, and/or combinations thereof) are performed under the control of one or more computer systems configured with executable instructions, and are implemented as code (e.g., executable instructions, one or more computer programs, or one or more applications) executing collectively on one or more processors. The code is stored on a computer-readable storage medium, for example, in the form of a computer program comprising instructions executable by one or more processors. The computer-readable storage medium is non-transitory. In some embodiments, one or more (or all) of the operations are performed by the text-to-speech service/component 110 of the other figures.

At 1002 a request to generate audio from input text. The request includes one or more of: text, a location of text, phonemes, a location of phonemes of the text, phoneme embeddings for the text, a location of phoneme embeddings for the text, linguistic levels to use (e.g., sentence, word, and phoneme, etc.), an indication of a highest linguistic level to use (e.g., sentence, word, or phoneme, etc.), a format of audio to be generated (e.g., using an uncompressed file format, a lossless audio format, or a lossy audio format), an identifier of a particular acoustic model to use, an identifier of a vocoder to use, and/or an indication of where to provide the generated audio (to a user, store in a particular location, etc.). Note the request may come from an external device (when a service is used), another service within a provider network, or a software routine within a computing device.

At 1004 audio is generated from the input text. This generation includes several acts depending on the utilized embodiment.

In some embodiments, phonemes for the input text are generated at 1006. There are multiple ways of accomplishing this generation and embodiments of a phoneme embedding encoder have been detailed above. When the request includes phonemes or an indication of where the phonemes are, this is skipped (but phonemes are retrieved as needed).

In some embodiments, phoneme embeddings are predicted from the generated phonemes at 1008. A discussion of exemplary phoneme embedding prediction has been previously presented. When the request includes phonemes embeddings or an indication of where the phonemes embeddings are, this is skipped (but phonemes embeddings are retrieved as needed).

At 1010 the phoneme embeddings are upsampled to "t" vectors (wherein "t" is a number of frames of a mel spectrogram to be produced by a decoder). The upsampling may be informed during training with the use of an oracle. During inference (such as what is described with this flow), the upsampling may be informed by a durations model.

At 1012 a plurality of spectrograms (at least one per linguistic level to be used) are generated. As discussed, this generation is performed in a hierarchical fashion where a coarser scale is used for the prediction representing speech on a finer scale. For example, sentence-level frames inform word-level frames, and both inform phoneme-level frames, etc.

In some embodiments, a prediction of one or more word-level spectrogram frames is made based on, at least in part, the generated phoneme embeddings that have been downsampled at 1014.

In some embodiments, the predicted word-level spectrogram frames are upsampled to predict aspects of phoneme-level spectrogram frames at 1016.

In some embodiments, the predicted word-level spectrogram frames are upsampled to generate "t" word-level spectrogram frames at 1018.

In some embodiments, phoneme-level spectrogram frames based on, at least in part, the generated phoneme embeddings are predicted at 1020. In some embodiments, the prediction of the phoneme-level spectrogram frames takes into account the predicted word-level spectrogram frames that were upsampled to predict aspects of phoneme-level spectrogram frames at 1016.

At 1022 the predicted phoneme-level spectrogram frames are upsampled to generate "t" frames of a phoneme-level spectrogram.

In some embodiments, post-processing is performed on any generated spectrograms and/or "t" upsampled embeddings at 1024.

The upsampled embeddings and upsampled spectrograms (e.g., word-level, phoneme-level, etc.) are combined (e.g., concatenated) at 1026

The combined upsampled embeddings and upsampled spectrograms are fed to a decoder to predict a mel spectrogram having t frames at 1028. Examples of a decoder have been detailed before.

A vocoder converts the mel spectrogram to audio at 1030. Note that the vocoder may be identified by the request.

The audio is output at 1032. This output may be in the form of saving a file, providing an audio file to a user, providing a stream of an audio file to user, etc.

Figure 11:
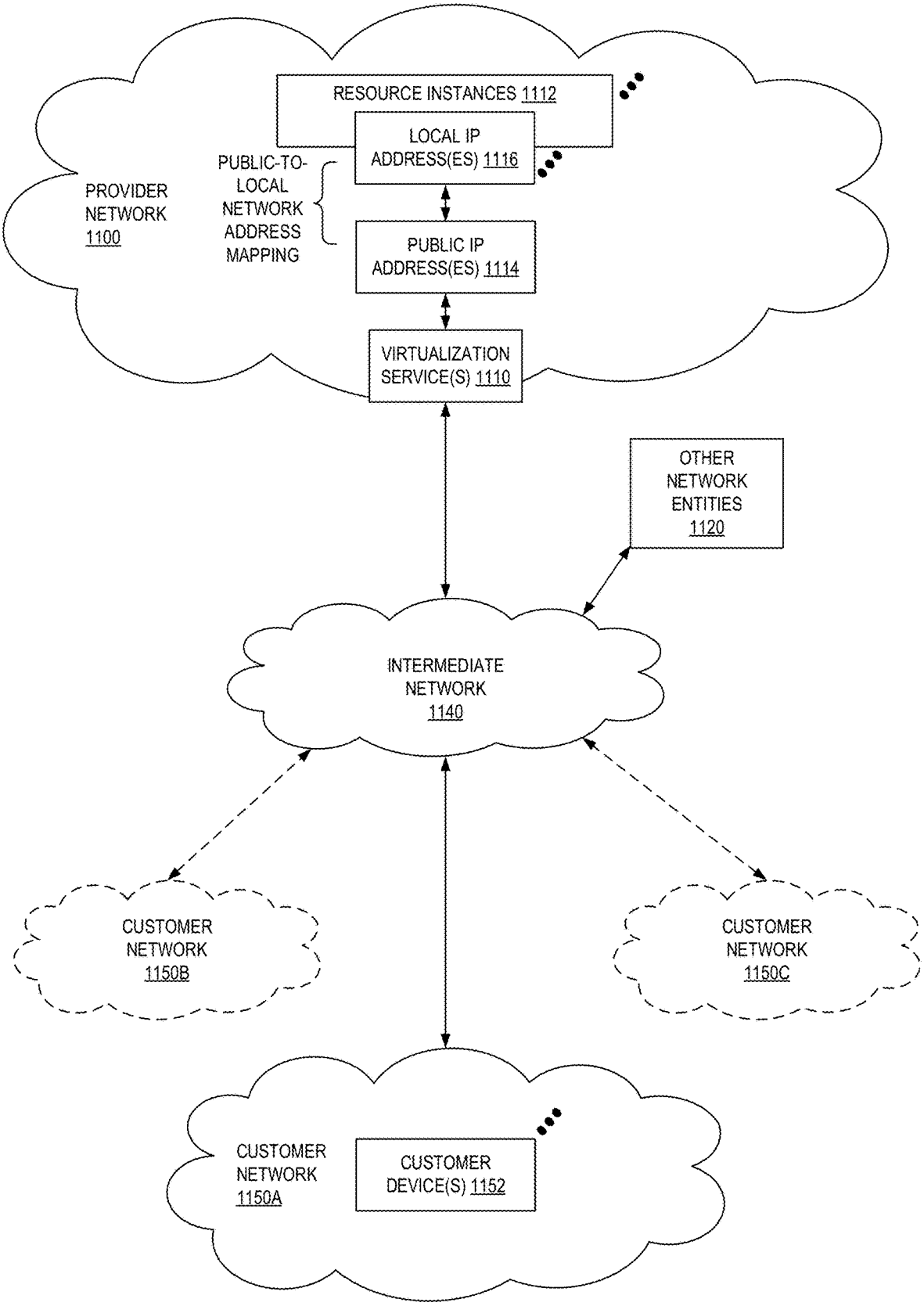
FIG. 11 illustrates an example provider network environment according to some embodiments.

FIG. 11 illustrates an example provider network (or "service provider system") environment according to some embodiments. A provider network 1100 may provide resource virtualization to customers via one or more virtualization services 1110 that allow customers to purchase, rent, or otherwise obtain instances 1112 of virtualized resources, including but not limited to computation and storage resources, implemented on devices within the provider network or networks in one or more data centers. Local Internet Protocol (IP) addresses 1116 may be associated with the resource instances 1112; the local IP addresses are the internal network addresses of the resource instances 1112 on the provider network 1100. In some embodiments, the provider network 1100 may also provide public IP addresses 1114 and/or public IP address ranges (e.g., Internet Protocol version 4 (IPv4) or Internet Protocol version 6 (IPv6) addresses) that customers may obtain from the provider 1100.

Conventionally, the provider network 1100, via the virtualization services 1110, may allow a customer of the service provider (e.g., a customer that operates one or more customer networks 1150A-1150C (may also be referred to as client networks) including one or more customer device(s) 1152) to dynamically associate at least some public IP addresses 1114 assigned or allocated to the customer with particular resource instances 1112 assigned to the customer. The provider network 1100 may also allow the customer to remap a public IP address 1114, previously mapped to one virtualized computing resource instance 1112 allocated to the customer, to another virtualized computing resource instance 1112 that is also allocated to the customer. Using the virtualized computing resource instances 1112 and public IP addresses 1114 provided by the service provider, a customer of the service provider such as the operator of the customer network(s) 1150A-1150C may, for example, implement customer-specific applications and present the customer's applications on an intermediate network 1140, such as the Internet. Other network entities 1120 on the intermediate network 1140 may then generate traffic to a destination public IP address 1114 published by the customer network(s) 1150A-1150C; the traffic is routed to the service provider data center, and at the data center is routed, via a network substrate, to the local IP address 1116 of the virtualized computing resource instance 1112 currently mapped to the destination public IP address 1114. Similarly, response traffic from the virtualized computing resource instance 1112 may be routed via the network substrate back onto the intermediate network 1140 to the source entity 1120.

Local IP addresses, as used herein, refer to the internal or "private" network addresses, for example, of resource instances in a provider network. Local IP addresses can be within address blocks reserved by Internet Engineering Task Force (IETF) Request for Comments (RFC) 1918 and/or of an address format specified by IETF RFC 4193, and may be mutable within the provider network. Network traffic originating outside the provider network is not directly routed to local IP addresses; instead, the traffic uses public IP addresses that are mapped to the local IP addresses of the resource instances. The provider network may include networking devices or appliances that provide network address translation (NAT) or similar functionality to perform the mapping from public IP addresses to local IP addresses and vice versa.

Public IP addresses are Internet mutable network addresses that are assigned to resource instances, either by the service provider or by the customer. Traffic routed to a public IP address is translated, for example via 1:1 NAT, and forwarded to the respective local IP address of a resource instance.

Some public IP addresses may be assigned by the provider network infrastructure to particular resource instances; these public IP addresses may be referred to as standard public IP addresses, or simply standard IP addresses. In some embodiments, the mapping of a standard IP address to a local IP address of a resource instance is the default launch configuration for all resource instance types.

At least some public IP addresses may be allocated to or obtained by customers of the provider network 1100; a customer may then assign their allocated public IP addresses to particular resource instances allocated to the customer. These public IP addresses may be referred to as customer public IP addresses, or simply customer IP addresses. Instead of being assigned by the provider network 1100 to resource instances as in the case of standard IP addresses, customer IP addresses may be assigned to resource instances by the customers, for example via an API provided by the service provider. Unlike standard IP addresses, customer IP addresses are allocated to customer accounts and can be remapped to other resource instances by the respective customers as necessary or desired. A customer IP address is associated with a customer's account, not a particular resource instance, and the customer controls that IP address until the customer chooses to release it. Unlike conventional static IP addresses, customer IP addresses allow the customer to mask resource instance or availability zone failures by remapping the customer's public IP addresses to any resource instance associated with the customer's account. The customer IP addresses, for example, enable a customer to engineer around problems with the customer's resource instances or software by remapping customer IP addresses to replacement resource instances.

Figure 12:
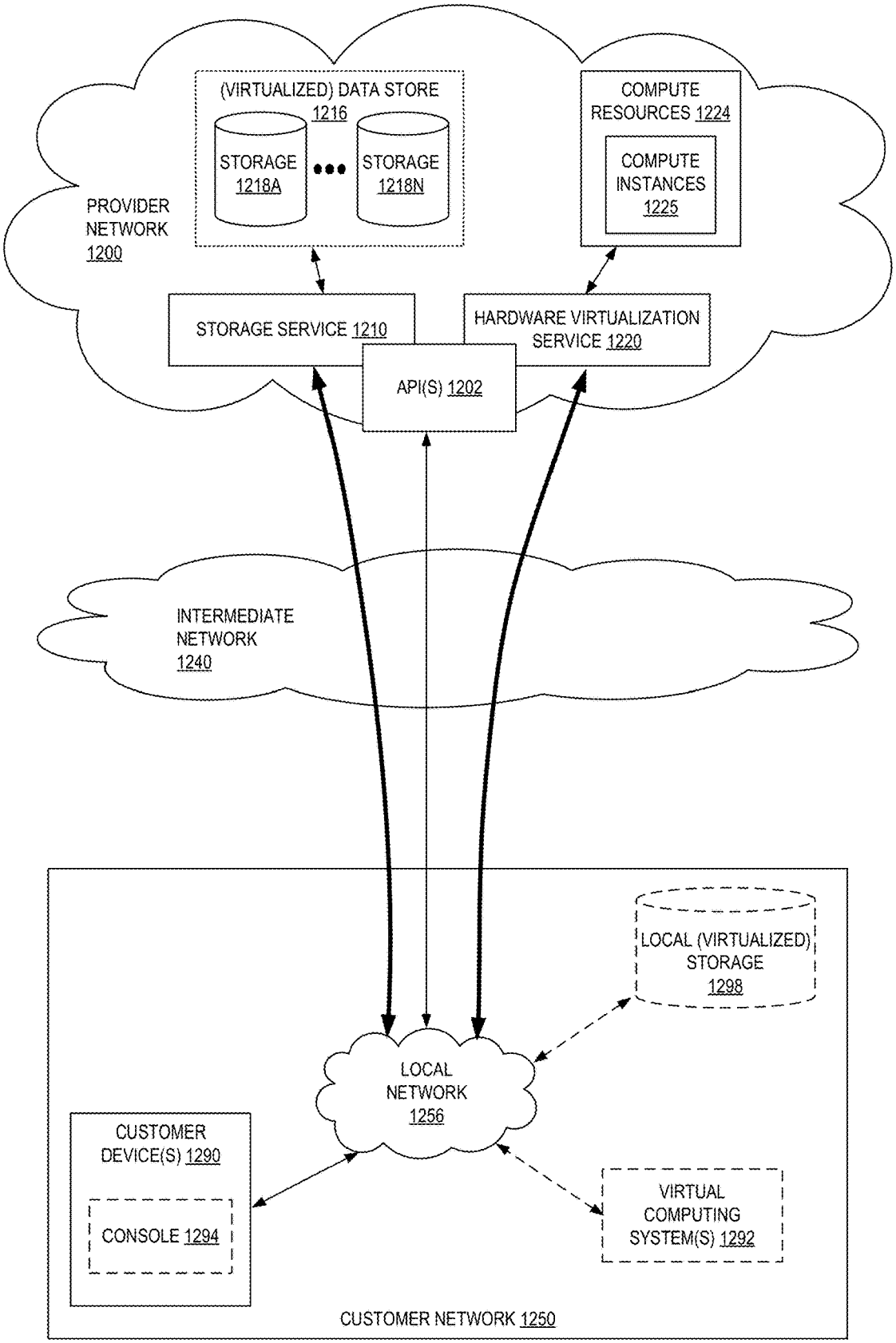
FIG. 12 is a block diagram of an example provider network that provides a storage service and a hardware virtualization service to customers according to some embodiments.

FIG. 12 is a block diagram of an example provider network environment that provides a storage service and a hardware virtualization service to customers, according to some embodiments. A hardware virtualization service 1220 provides multiple compute resources 1224 (e.g., compute instances 1225, such as VMs) to customers. The compute resources 1224 may, for example, be rented or leased to customers of a provider network 1200 (e.g., to a customer that implements a customer network 1250). Each computation resource 1224 may be provided with one or more local IP addresses. The provider network 1200 may be configured to route packets from the local IP addresses of the compute resources 1224 to public Internet destinations, and from public Internet sources to the local IP addresses of the compute resources 1224.

The provider network 1200 may provide the customer network 1250, for example coupled to an intermediate network 1240 via a local network 1256, the ability to implement virtual computing systems 1292 via the hardware virtualization service 1220 coupled to the intermediate network 1240 and to the provider network 1200. In some embodiments, the hardware virtualization service 1220 may provide one or more APIs 1202, for example a web services interface, via which the customer network 1250 may access functionality provided by the hardware virtualization service 1220, for example via a console 1294 (e.g., a web-based application, standalone application, mobile application, etc.) of a customer device 1290. In some embodiments, at the provider network 1200, each virtual computing system 1292 at the customer network 1250 may correspond to a computation resource 1224 that is leased, rented, or otherwise provided to the customer network 1250.

From an instance of the virtual computing system(s) 1292 and/or another customer device 1290 (e.g., via console 1294), the customer may access the functionality of a storage service 1210, for example via the one or more APIs 1202, to access data from and store data to storage resources 1218A-1218N of a virtual data store 1216 (e.g., a folder or "bucket," a virtualized volume, a database, etc.) provided by the provider network 1200. In some embodiments, a virtualized data store gateway (not shown) may be provided at the customer network 1250 that may locally cache at least some data, for example frequently accessed or critical data, and that may communicate with the storage service 1210 via one or more communications channels to upload new or modified data from a local cache so that the primary store of data (the virtualized data store 1216) is maintained. In some embodiments, a user, via the virtual computing system 1292 and/or another customer device 1290, may mount and access virtual data store 1216 volumes via the storage service 1210 acting as a storage virtualization service, and these volumes may appear to the user as local (virtualized) storage 1298.

While not shown in FIG. 12, the virtualization service(s) may also be accessed from resource instances within the provider network 1200 via the API(s) 1202. For example, a customer, appliance service provider, or other entity may access a virtualization service from within a respective virtual network on the provider network 1200 via the API(s) 1202 to request allocation of one or more resource instances within the virtual network or within another virtual network.

Illustrative Systems

Figure 13:
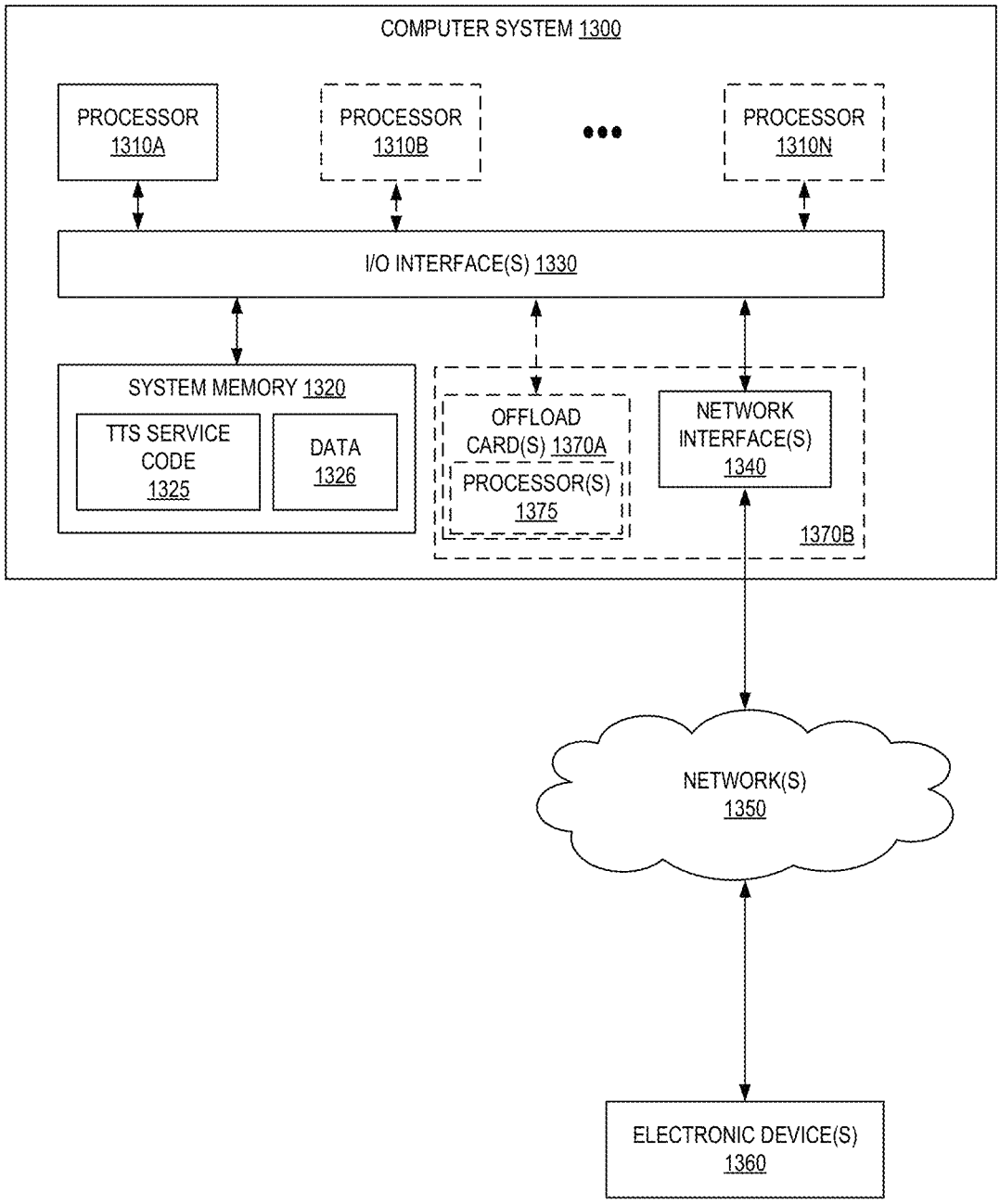
FIG. 13 is a block diagram illustrating an example computer system that may be used in some embodiments.

In some embodiments, a system that implements a portion or all of the techniques described herein may include a general-purpose computer system, such as the computer system 1300 illustrated in FIG. 13, that includes, or is configured to access, one or more computer-accessible media. In the illustrated embodiment, the computer system 1300 includes one or more processors 1310 coupled to a system memory 1320 via an input/output (I/O) interface 1330. The computer system 1300 further includes a network interface 1340 coupled to the I/O interface 1330. While FIG. 13 shows the computer system 1300 as a single computing device, in various embodiments the computer system 1300 may include one computing device or any number of computing devices configured to work together as a single computer system 1300.

In various embodiments, the computer system 1300 may be a uniprocessor system including one processor 1310, or a multiprocessor system including several processors 1310 (e.g., two, four, eight, or another suitable number). The processor(s) 1310 may be any suitable processor(s) capable of executing instructions. For example, in various embodiments, the processor(s) 1310 may be general-purpose or embedded processors implementing any of a variety of instruction set architectures (ISAs), such as the x86, ARM, PowerPC, SPARC, or MIPS ISAs, or any other suitable ISA. In multiprocessor systems, each of the processors 1310 may commonly, but not necessarily, implement the same ISA.

The system memory 1320 may store instructions and data accessible by the processor(s) 1310. In various embodiments, the system memory 1320 may be implemented using any suitable memory technology, such as random-access memory (RAM), static RAM (SRAM), synchronous dynamic RAM (SDRAM), nonvolatile/Flash-type memory, or any other type of memory. In the illustrated embodiment, program instructions and data implementing one or more desired functions, such as those methods, techniques, and data described above, are shown stored within the system memory 1320 as TTS service code 1325 (e.g., executable to implement, in whole or in part, the TTS service/component 110) and data 1326.

In one embodiment, the I/O interface 1330 may be configured to coordinate I/O traffic between the processor 1310, the system memory 1320, and any peripheral devices in the device, including the network interface 1340 and/or other peripheral interfaces (not shown). In some embodiments, the I/O interface 1330 may perform any necessary protocol, timing, or other data transformations to convert data signals from one component (e.g., the system memory 1320) into a format suitable for use by another component (e.g., the processor 1310). In some embodiments, the I/O interface 1330 may include support for devices attached through various types of peripheral buses, such as a variant of the Peripheral Component Interconnect (PCI) bus standard or the Universal Serial Bus (USB) standard, for example. In some embodiments, the function of the I/O interface 1330 may be split into two or more separate components, such as a north bridge and a south bridge, for example. Also, in some embodiments, some or all of the functionality of the I/O interface 1330, such as an interface to the system memory 1320, may be incorporated directly into the processor 1310.

The network interface 1340 may be configured to allow data to be exchanged between the computer system 1300 and other devices 1360 attached to a network or networks 1350, such as other computer systems or devices as illustrated in FIG. 1, for example. In various embodiments, the network interface 1340 may support communication via any suitable wired or wireless general data networks, such as types of Ethernet network, for example. Additionally, the network interface 1340 may support communication via telecommunications/telephony networks, such as analog voice networks or digital fiber communications networks, via storage area networks (SANs), such as Fibre Channel SANs, and/or via any other suitable type of network and/or protocol.

In some embodiments, the computer system 1300 includes one or more offload cards 1370A or 1370B (including one or more processors 1375, and possibly including the one or more network interfaces 1340) that are connected using the I/O interface 1330 (e.g., a bus implementing a version of the Peripheral Component Interconnect-Express (PCI-E) standard, or another interconnect such as a QuickPath interconnect (QPI) or UltraPath interconnect (UPI)). For example, in some embodiments the computer system 1300 may act as a host electronic device (e.g., operating as part of a hardware virtualization service) that hosts compute resources such as compute instances, and the one or more offload cards 1370A or 1370B execute a virtualization manager that can manage compute instances that execute on the host electronic device. As an example, in some embodiments the offload card(s) 1370A or 1370B can perform compute instance management operations, such as pausing and/or un-pausing compute instances, launching and/or terminating compute instances, performing memory transfer/copying operations, etc. These management operations may, in some embodiments, be performed by the offload card(s) 1370A or 1370B in coordination with a hypervisor (e.g., upon a request from a hypervisor) that is executed by the other processors 1310A-1310N of the computer system 1300. However, in some embodiments the virtualization manager implemented by the offload card(s) 1370A or 1370B can accommodate requests from other entities (e.g., from compute instances themselves), and may not coordinate with (or service) any separate hypervisor.

In some embodiments, the system memory 1320 may be one embodiment of a computer-accessible medium configured to store program instructions and data as described above. However, in other embodiments, program instructions and/or data may be received, sent, or stored upon different types of computer-accessible media. Generally speaking, a computer-accessible medium may include any non-transitory storage media or memory media such as magnetic or optical media, e.g., disk or DVD/CD coupled to the computer system 1300 via the I/O interface 1330. A non-transitory computer-accessible storage medium may also include any volatile or non-volatile media such as RAM (e.g., SDRAM, double data rate (DDR) SDRAM, SRAM, etc.), read only memory (ROM), etc., that may be included in some embodiments of the computer system 1300 as the system memory 1320 or another type of memory. Further, a computer-accessible medium may include transmission media or signals such as electrical, electromagnetic, or digital signals, conveyed via a communication medium such as a network and/or a wireless link, such as may be implemented via the network interface 1340.

Various embodiments discussed or suggested herein can be implemented in a wide variety of operating environments, which in some cases can include one or more user computers, computing devices, or processing devices which can be used to operate any of a number of applications. User or client devices can include any of a number of general-purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially available operating systems and other known applications for purposes such as development and database management. These devices also can include other electronic devices, such as dummy terminals, thin-clients, gaming systems, and/or other devices capable of communicating via a network.

Most embodiments use at least one network that would be familiar to those skilled in the art for supporting communications using any of a variety of widely-available protocols, such as Transmission Control Protocol/Internet Protocol (TCP/IP), File Transfer Protocol (FTP), Universal Plug and Play (UPnP), Network File System (NFS), Common Internet File System (CIFS), Extensible Messaging and Presence Protocol (XMPP), AppleTalk, etc. The network(s) can include, for example, a local area network (LAN), a wide-area network (WAN), a virtual private network (VPN), the Internet, an intranet, an extranet, a public switched telephone network (PSTN), an infrared network, a wireless network, and any combination thereof.

In embodiments using a web server, the web server can run any of a variety of server or mid-tier applications, including HTTP servers, File Transfer Protocol (FTP) servers, Common Gateway Interface (CGI) servers, data servers, Java servers, business application servers, etc. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, PHP, or TCL, as well as combinations thereof. The server(s) may also include database servers, including without limitation those commercially available from Oracle®, Microsoft®, Sybase®, IBM®, etc. The database servers may be relational or non-relational (e.g., "NoSQL"), distributed or non-distributed, etc.

Environments disclosed herein can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network (SAN) familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and/or at least one output device (e.g., a display device, printer, or speaker). Such a system may also include one or more storage devices, such as disk drives, optical storage devices, and solid-state storage devices such as random-access memory (RAM) or read-only memory (ROM), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, Electrically Erasable Programmable Read-Only Memory (EEPROM), flash memory or other memory technology, Compact Disc-Read Only Memory (CD-ROM), Digital Versatile Disk (DVD) or other optical storage, magnetic cassettes, magnetic tape, magnetic disk storage or other magnetic storage devices, or any other medium which can be used to store the desired information and which can be accessed by a system device. Based on the disclosure and teachings provided herein, a person of ordinary skill in the art will appreciate other ways and/or methods to implement the various embodiments.

In the preceding description, various embodiments are described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Bracketed text and blocks with dashed borders (e.g., large dashes, small dashes, dot-dash, and dots) are used herein to illustrate optional operations that add additional features to some embodiments. However, such notation should not be taken to mean that these are the only options or optional operations, and/or that blocks with solid borders are not optional in certain embodiments.

Reference numerals with suffix letters may be used to indicate that there can be one or multiple instances of the referenced entity in various embodiments, and when there are multiple instances, each does not need to be identical but may instead share some general traits or act in common ways. Further, the particular suffixes used are not meant to imply that a particular amount of the entity exists unless specifically indicated to the contrary. Thus, two entities using the same or different suffix letters may or may not have the same number of instances in various embodiments.

References to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Moreover, in the various embodiments described above, unless specifically noted otherwise, disjunctive language such as the phrase "at least one of A, B, or C" is intended to be understood to mean either A, B, or C, or any combination thereof (e.g., A, B, and/or C). Similarly, language such as "at least one or more of A, B, and C" (or "one or more of A, B, and C") is intended to be understood to mean A, B, or C, or any combination thereof (e.g., A, B, and/or C). As such, disjunctive language is not intended to, nor should it be understood to, imply that a given embodiment requires at least one of A, at least one of B, and at least one of C to each be present.

Unless otherwise explicitly stated, articles such as "a" or "an" should generally be interpreted to include one or multiple described items. Accordingly, phrases such as "a device configured to" or "a computing device" are intended to include one or multiple recited devices. Such one or more recited devices can be collectively configured to carry out the stated operations. For example, "a processor configured to carry out operations A, B, and C" can include a first processor configured to carry out operation A working in conjunction with a second processor configured to carry out operations B and C.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

What is claimed is:

1. A computer-implemented method comprising:

receiving a request to generate audio from input text, wherein the input text is in a form of phonemes;

generating audio from the input text by:

generating phoneme embeddings for the phonemes, upsampling the phoneme embeddings to a first number of vectors, wherein the first number of vectors corresponds to a number of frames of a mel spectrogram to be generated by an acoustic model, generating a plurality of linguistic-level spectrograms, at least one per word-level and phoneme-level by:

predicting of one or more word-level spectrogram frames based on, at least in part, the generated phoneme embeddings that have been down-sampled, upsampling the predicted one or more word-level spectrogram frames to one or more phoneme-level frames, upsampling the predicted one or more word-level spectrogram frames to one or more word-level spectrograms have the first number of frames, predicting phoneme-level spectrogram frames based on, at least in part, the generated phoneme embeddings and the phoneme-level frames generated by upsampling the predicted one or more word-level spectrogram frames, and upsampling the predicted phoneme-level spectrogram frames to generate the first number of frames of a phoneme-level spectrogram, concatenating the first number of vectors and word-level and phoneme-level spectrograms, generating at least one mel spectrogram having the first number of frames using an auto-regressive decoder from the concatenated first number of vectors and linguistic-level spectrograms, converting, with a vocoder, the at least one mel spectrogram frames to audio; and outputting the generated audio according to the request.

2. The computer-implemented method of claim 1, wherein the vocoder is neural network based.

3. The computer-implemented method of claim 1, wherein the request includes one or more of: text, a location of text, phonemes, a location of phonemes, linguistic levels to use, an indication of a highest linguistic level to use, a format of audio to be generated, an identifier of a particular acoustic model to use, an identifier of the vocoder to use, or an indication of where to provide the generated audio.

4. A computer-implemented method comprising:

receiving a request to generate audio from input text;

generating audio from the input text by:

generating a first number of vectors from phoneme embeddings representing the input text, predicting one or more spectrograms having the first number of frames using multiple scales wherein a coarser scale influences a finer scale, concatenating the first number of vectors and the predicted one or more spectrograms, generating at least one mel spectrogram from the concatenated vectors and the predicted one or more spectrograms, and converting, with a vocoder, the at least one mel spectrogram frames to audio; and outputting the generated audio according to the request.

5. The computer-implemented method of claim 4, wherein the generating one or more spectrograms having the first number of frames comprises:

generating phoneme-level spectrograms by:

predicting phoneme-level spectrogram frames based on, at least in part, phoneme embeddings, and upsampling the predicted phoneme-level spectrogram frames are to generate the first number of frames of a phoneme-level vector.

6. The computer-implemented method of claim 5, wherein the generating one or more spectrograms having the first number of frames further comprises:

generating word-level spectrograms by:

predicting of one or more word-level spectrogram frames based on, at least in part, phoneme embeddings that have been downsampled, and upsampling the predicted one or more word-level spectrogram frames to one or more word-level spectrograms have the first number of frames;

wherein the generating phoneme-level spectrogram frames utilizes upsampled predicted one or more word-level spectrogram frames to one or more phoneme-level vector.

7. The computer-implemented method of claim 6, wherein the generating one or more sentence-level spectrograms having the first number of frames, wherein the generation of the word-level spectrograms and phoneme-level spectrograms utilizes sentence-level frame information.

8. The computer-implemented method of claim 4, wherein the text input is phoneme-based.

9. The computer-implemented method of claim 4, wherein the text input is in a character format, the method further comprising:

converting the character formatted text to phonemes.

10. The computer-implemented method of claim 4, wherein the mel spectrogram has an 80-band spectrum with 12.5 ms frames.

11. The computer-implemented method of claim 4, wherein the request includes one or more of: text, a location of text, phonemes, a location of phonemes, linguistic levels to use, an indication of a highest linguistic level to use, a format of audio to be generated, an identifier of a particular acoustic model to use, an identifier of the vocoder to use, or an indication of where to provide the generated audio.

12. The computer-implemented method of claim 4, wherein the generating at least one mel spectrogram from the concatenated phoneme embeddings and spectrogram frames is performed using an autoregressive decoder.

13. The computer-implemented method of claim 4, wherein the vocoder is neural network based.

14. The computer-implemented method of claim 4, wherein the generating at least one mel spectrogram from the concatenated phoneme embeddings and spectrogram frames is performed using a parallel decoder.

15. A system comprising:

a first one or more electronic devices to implement a vocoder in a multi-tenant provider network; and a second one or more electronic devices to implement an acoustic model in the multi-tenant provider network, the acoustic model including instructions that upon execution cause the acoustic model to:

receive a request to generate audio from input text;

generate audio from the input text by:

generating a first number of vectors from phoneme embeddings representing the input text, predicting one or more spectrograms having the first number of frames using multiple scales wherein a coarser scale influences a finer scale, concatenating the first number of vectors and the predicted one or more spectrograms, generating at least one mel spectrogram from the concatenated vectors and the predicted one or more spectrograms, and converting, with the vocoder, the at least one mel spectrogram frames to audio; and outputting the generated audio according to the request.

16. The system of claim 15, wherein the vocoder is neural network based.

17. The system of claim 15, wherein the request includes one or more of: text, a location of text, phonemes, a location of phonemes, linguistic levels to use, an indication of a highest linguistic level to use, a format of audio to be generated, an identifier of a particular acoustic model to use, an identifier of the vocoder to use, or an indication of where to provide the generated audio.

18. The system of claim 15, wherein the mel spectrogram has an 80-band spectrum with 12.5 ms frames.

19. The system of claim 15, wherein the text input is phoneme-based.

20. The system of claim 15, wherein the text input is in a character format and a front end is to convert the character formatted text to phonemes.

* * * * *